US007778579B2

(12) United States Patent
Ueda et al.

(10) Patent No.: US 7,778,579 B2
(45) Date of Patent: Aug. 17, 2010

(54) COLOR IMAGE FORMING APPARATUS WHICH EXECUTES COLOR MISREGISTRATION CORRECTION PROCESSING

(75) Inventors: Tadayuki Ueda, Kokubunji (JP); Shigeo Ogino, Toyokawa (JP); Masaaki Goto, Hachioji (JP); Hiroyuki Watanabe, Hachioji (JP); Akifumi Isobe, Hidaka (JP); Yoshihito Sasamoto, Hachioji (JP); Takashi Nara, Niiza (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 774 days.

(21) Appl. No.: 11/713,511

(22) Filed: Mar. 2, 2007

(65) Prior Publication Data

US 2007/0274745 A1 Nov. 29, 2007

(30) Foreign Application Priority Data

Apr. 19, 2006 (JP) ..... 2006-115734

(51) Int. Cl.
*G03G 15/01* (2006.01)

(52) U.S. Cl. ..... 399/301; 347/116

(58) Field of Classification Search ..... 399/301; 347/116

See application file for complete search history.

(56) References Cited

U.S. PATENT DOCUMENTS 7,616,909 B2 * 11/2009 Kato et al. ..... 399/301

FOREIGN PATENT DOCUMENTS

JP 2005-091901 A 4/2005

* cited by examiner

*Primary Examiner*—William J Royer
(74) *Attorney, Agent, or Firm*—Frishauf, Holtz, Goodman & Chick, P.C.

(57) ABSTRACT

A tandem type color image forming apparatus which executes color misregistration correction, including: a detecting section which detects a width of a transfer sheet; an image forming section having an image carrier, on which arranged side by side are an image area where formed is an image for transfer and a non-image area where formed is an imprint image; and a control section which selects a complex or a single correction mode based on the transfer sheet width, to execute correction processing; where the complex correction mode is an operation mode of forming in parallel the image for transfer in the image area and the imprint image in the non-image area, and the single correction mode is an operation mode of suspending to form the image for transfer in the image area, and executing only to form the imprint image in the non-image area or in the image area.

20 Claims, 11 Drawing Sheets

CR
12A
(i)
θ
(ii)
SUB-SCANNING DIRECTION

S21
L1
Lth
L2
a
b
c
d

VTOP

SP=Dp
t0
ta
tb
tc
td
FIG. 10 (E) D[T1]
T1
FIG. 10 (F) D[T2]
T2
FIG. 10 (G) D[T3]
T3
FIG. 10 (H) D[T4]
T4

COLOR IMAGE FORMING APPARATUS WHICH EXECUTES COLOR MISREGISTRATION CORRECTION PROCESSING

CROSS REFERENCE TO RELATED APPLICATION

The present application is based on Japanese Patent Application No. 2006-115734 filed with the Japan Patent Office on Apr. 19, 2006, the entire content of which is hereby incorporated by reference.

BACKGROUND OF THE INVENTION

1. Technical Field

The present invention relates to color image forming apparatuses that are suitable for application to a color printer, a color copying machine, or a multi functional product that has a photoreceptor drum and an intermediate image transfer belt, and carries out color misregistration correction processing by selecting either a color registration complex correction mode or a color registration single correction mode, or to color multi functional products of these types.

2. Description of Related Art

In recent years, tandem type color printers or color copying machines, or color multi functional products are being used very frequently. According to these types of color image forming apparatuses, in order to maintain at an optimum level the print quality (color reproducibility) of color images, the colors yellow (Y), magenta (M), cyan (C), and black (BK) that reproduce the colors R, G, and BK of the original document image are transferred onto an intermediate image transfer belt in a superimposing manner. In order to superimpose each of the colors Y, M, C, and BK with good reproducibility, it has become necessary to carry out actively color misregistration correction in an image forming unit (hereinafter referred to as a color misregistration correction mode).

Regarding the color misregistration correction mode, a color misregistration detection mark (hereinafter referred to as a register mark) for position detection formed on the intermediate image transfer belt or conveying member transfer belt is detected by a detection member (hereinafter referred to as a register sensor) for detecting color misregistration such as a reflection type sensor, etc., an amount of color misregistration of register marks of other colors with respect to a register mark of a reference color, fed back to different image forming units of the colors Y, M, and C so as to eliminate this amount of color misregistration, and good quality color images are obtained by correcting a laser writing timing.

Regarding these types of color copying machines, a color image forming apparatus has been disclosed in Patent Document 1. According to this color image forming apparatus, when a position deviation detection pattern is detected and color misregistration correction processing is executed based on a result of this detection, a pattern for density detection is formed in a non-image area, the pattern for density detection is detected, and a condition for creating an image for a position displacement detection pattern during color misregistration correction processing. When this type of color image recording apparatus is configured, it is possible to carry out color misregistration correction processing using the position displacement detection pattern whose density has been adjusted.

Patent Document 1: Unexamined Japanese Patent Application Publication No. 2005-91901 (Page 7, FIG. 9).

However, the following problems are present in color image forming apparatuses according to conventional examples as those seen in Patent Document 1.

(i). When carrying out color misregistration correction processing, a pattern for density detection is formed in the non-image area and the conditions for writing the position deviation detection pattern (a register mark) are determined by detecting this pattern for density detection. Therefore, even if it is possible to form a density adjusted register mark, it will be necessary to carry out again color misregistration correction at various image forming conditions at regular intervals due to an expansion or contraction of a writing unit, or the expansion or contraction of various types of drive rollers due to temperature conditions inside the apparatus.

(ii). In color misregistration correction operation, conventionally, when a timing of that color registration operation has come, irrespective of whether a paper size is small or large, either a job under printing operation is interrupted, or the color misregistration correction operation is made at the time of starting the print operation, and thereafter, again, the printing operation is started, and hence time was necessary only for carrying out the color misregistration correction operation. In particular, there was the problem that the color misregistration correction time became long in office applications, and the productivity of color copiers decreased.

(iii). However, when an apparatus is attempted to be configured in which the register mark is written in the non-image area outside the effective image area and the color misregistration correction processing is done continuously during the printing operation, it will be necessary to prepare a photoreceptor drum or an intermediate image transfer belt that is wider than the maximum size of the recording transfer sheets handled by that apparatus. Because of this, there was the problem that size reduction of the color copying machine was impeded and the cost went up by a large amount.

In view of this, the present invention is one that solves the above problems, and the purpose of the present invention is to provide a color image forming apparatus that not only shortens the color misregistration correction time on the whole compared to the color misregistration correction mode of the conventional method, but also increases the productivity of that apparatus.

SUMMARY OF THE INVENTION

A color image forming apparatus reflecting one aspect of the present invention for solving the above problems is, a tandem type color image forming apparatus which executes color misregistration correction processing by detecting an imprint image for color misregistration correction, the color image forming apparatus including:

an image forming section;

a detecting section which detects a width of a transfer sheet fed to the image forming section and outputs the transfer sheet width information; and a control section which controls the image forming section based on the transfer sheet width information output by the detecting section, wherein the image forming section has an image carrier, on which an image area in which formed is an image for transfer to the transfer sheet and a non-image area in which formed is the imprint image for color misregistration correction are arranged side by side along a main scanning direction, and a scanning exposure width in the main scanning direction is greater than a maximum width of the transfer sheet, wherein the control section selects either one of a color misregistration complex correction mode or a color misregistration single correction mode based on the transfer sheet width information, and executes the color misregistration correction processing, where, the color misregistration complex correction mode is an operation mode of executing in parallel a processing of forming the image for transfer in the image area and a processing of forming the imprint image in the non-image area, and the color misregistration single correction mode is an operation of suspending the processing of forming the image for transfer in the image area, and executing only the processing of forming the imprint image in the non-image area or in the image area.

A color image forming apparatus reflecting another aspect of the present invention has the feature that, in the above apparatus, the control section compares a width of the image area and a width of the transfer sheet, and selects the color misregistration complex correction mode when the width of the transfer sheet is not greater than the width of the image area, and selects the color misregistration single correction mode when the width of the transfer sheet is greater than the width of the image area.

BRIEF DESCRIPTION OF THE DRAWINGS

These and other objects, advantages and features of the invention will become apparent from the following description thereof taken in conjunction with the accompanying drawings in which.

DETAILED DESCRIPTION OF THE PREFERRED EMBODIMENT

Figure 1:
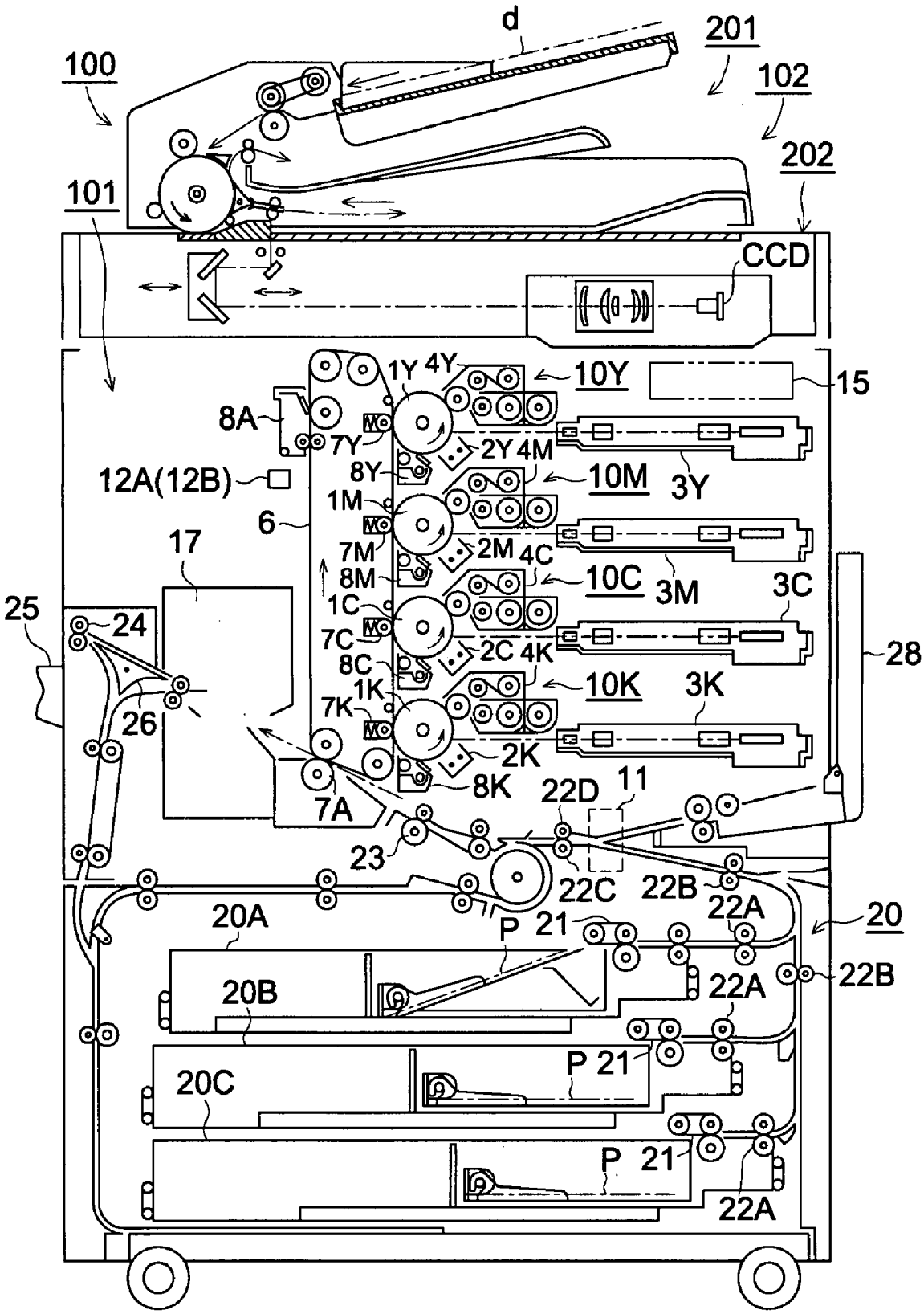
FIG. 1 is a schematic diagram showing an example of a configuration of a color copying machine according to a preferred embodiment of the present invention.

In the following, a color image forming apparatus according to a preferred embodiment of the present invention is explained referring to the drawings.

FIG. 1 is a schematic diagram showing an example of a configuration of a color copying machine 100 according to a preferred embodiment of the present invention. The color copying machine 100 shown in FIG. 1 constitutes an example of a tandem type color image forming apparatus, and forms color images by superimposing colors on an image carrier based on image information. The color copying machine 100 executes color misregistration correction processing according to the need.

At the time of executing this color misregistration correction processing, this copying machine 100 selects either one of a color misregistration complex correction mode (job-continuing register correction mode) or a color misregistration single correction mode (job-stopping register correction mode) based on a transfer sheet width information and executes the color misregistration correction processing. Here, the color misregistration complex correction mode is the operation of executing in parallel the processing of writing the image in an image area of the image carrier and the processing of writing an imprint image in its non-image area. The color misregistration single correction mode is the operation of suspending the processing of writing an image in the image area and executing only the processing of writing the imprint image in the non-image area or in the image area.

In both the above mode and the color misregistration single correction mode, the operation is carried out of, after carrying out the processing of writing the imprint image, reading out the timing of passing of that imprint image, calculating the displacements in the positions of the imprint images of other colors with respect to the imprint image of the reference color, and correcting the image forming position based on these amounts of position displacements (color misregistration correction processing). These correction modes are executed after switching between them depending on the size of the transfer sheet P.

The color copying machine 100 is made of a copying machine main unit 101 and an image reading unit 102. The image reading unit 102 having an automatic document feeder unit 201 and an original document image scanning and exposing unit 202 is placed on top of the copying machine main unit 101. An original document d placed on a document table of the automatic document feeder unit 201 is conveyed by a conveying section not shown in the figure, an image on one side or both sides of the document d is exposed in a scanning manner by an optical system of the document image scanning and exposing unit 202, and the incident light reflecting the document image is read out by a line image sensor CCD.

An analog image signal that is obtained by photoelectric conversion by the line image sensor CCD is, in an image processing section not shown in the figure, subjected to the processings of analog signal processing, analog to digital conversion, shading correction, and image compression, and becomes digital image information. This image information is sent to an image forming section. The image forming section is provided with a plurality of sets of image forming units (hereinafter referred to as image forming systems II) 10Y, 10M, 10C, and 10K having a photoreceptor for each color, an endless shaped intermediate image transfer belt 6 (hereinafter referred to as image transfer system I), a sheet feeding and conveying section that includes and automatic sheet feeding mechanism (ADU mechanism), and a fixing unit 17 for fixing a toner image.

In this example, the image forming unit 10Y has a photoreceptor drum 1Y (image forming member), a charging unit 2Y, a writing unit 3Y, a developing unit 4Y, and a cleaning section 8Y for the image forming member, and forms images of yellow (Y) color.

The photoreceptor drum 1Y constitutes an example of an image carrier, and is placed, for example, at a close proximity to and above the right side of the intermediate image transfer belt 6 so that it is free to rotate, and a color Y toner image is formed on it. In this example, the photoreceptor drum 1Y is rotated in the counter-clockwise direction by a drive mechanism not shown in the figure. To the diagonally lower right side of the photoreceptor drum 1Y is placed the charging unit 2Y which charges the surface of the photoreceptor drum 1Y to a prescribed voltage.

The writing unit 3Y having a laser light source is provided almost by the side of and directly facing the photoreceptor drum 1Y, and scans the previously charged photoreceptor drum 1Y with a laser light beam for the color Y having a prescribed intensity based on image data for the color Y. This laser light beam is deflected and scanned, for example, by rotating a polygon mirror for the color Y, which is the writing of the Y color image data in the main scanning direction. The main scanning direction is the direction parallel to the axis of rotation of the photoreceptor drum 1Y. The photoreceptor drum 1Y rotates in the sub scanning direction. The sub scanning direction is a direction at right angles to the axis of rotation of the photoreceptor drum 1Y. An electrostatic latent image for the color Y is formed on the photoreceptor drum 1Y because of this photoreceptor drum 1Y rotating in the sub scanning direction and also the deflection and scanning of the laser light beam in the main scanning direction.

The developing unit 4Y is provided above the writing unit 3Y, and operates so as to develop the electrostatic latent image for the color Y formed on the photoreceptor drum 1Y. The developing unit 4Y has a developing roller for the color Y which is not shown in the figure. The toner and carrier for the color Y are stored in the developing unit 4Y. The developing roller for the color Y has a magnet placed inside it, and rotates and conveys a two-component developer obtained by stirring the carrier and the color Y toner inside the developing unit 4Y to the opposing part of the photoreceptor drum 1Y, and the electrostatic latent image is developed by the color Y toner. This color Y toner image formed on the photoreceptor drum 1Y is transferred to the intermediate image transfer belt 6 by operating a primary transfer roller 7Y (primary transfer). To the lower left side of the photoreceptor drum 1Y is provided the cleaning section 8Y which removes the toner that is remaining on the photoreceptor drum 1Y from the previous writing operation (cleaning).

In this example, the image forming unit 10M is provided on the lower side of the image forming unit 10Y. The image forming unit 10M has a photoreceptor drum 1M, a charging unit 2M, a writing unit 3M, a developing unit 4M, and a cleaning section 8M for the image forming member, and forms images of magenta (M) color.

The photoreceptor drum 1M constitutes an example of an image carrier, and is placed, for example, on the lower side of the above photoreceptor drum 1Y, at a close proximity to and above the right side of the intermediate image transfer belt 6 so that it is free to rotate, and a color M toner image is formed on it. In this example, the photoreceptor drum 1M is rotated in the counter-clockwise direction by a drive mechanism not shown in the figure. To the diagonally lower right side of the photoreceptor drum 1M is placed the charging unit 2M which charges the surface of the photoreceptor drum 1M to a prescribed voltage.

The writing unit 3M is provided almost by the side of and directly facing the photoreceptor drum 1M, and scans the previously charged photoreceptor drum 1M with a laser light beam for the color M having a prescribed intensity based on the image data for the color M. This laser light beam is deflected and scanned, for example, by rotating a polygon mirror for the color M, which is the writing of the M color image data in the main scanning direction. The photoreceptor drum 1M rotates in the sub scanning direction. An electrostatic latent image for the color M is formed on the photoreceptor drum 1M because of this photoreceptor drum 1M rotating in the sub scanning direction and also the deflection and scanning of the laser light beam in the main scanning direction.

The developing unit 4M is provided above the writing unit 3M, and operates so as to develop the electrostatic latent image for the color M formed on the photoreceptor drum 1M. The developing unit 4M has a developing roller for the color M which is not shown in the figure. The toner and carrier for the color M are stored in the developing unit 4M. The developing roller for the color M has a magnet placed inside it, and rotates and conveys a two-component developer obtained by stirring the carrier and the color M toner inside the developing unit 4M to the opposing part of the photoreceptor drum 1M, and the electrostatic latent image is developed by the color M toner. This color M toner image formed on the photoreceptor drum 1M is transferred to the intermediate image transfer belt 6 by operating a primary transfer roller 7M (primary transfer). To the lower left side of the photoreceptor drum 1M is provided the cleaning section 8M which cleans the toner that is remaining on the photoreceptor drum 1M from the previous writing operation.

In this example, the image forming unit 10C is provided on the lower side of the image forming unit 10M. The image forming unit 10C has a photoreceptor drum 1C, a charging unit 2C, a writing unit 3C, a developing unit 4C, and a cleaning section 8C for the image forming member, and forms images of cyan (C) color.

The photoreceptor drum 1C constitutes an example of an image carrier, and is placed, for example, on the lower side of the above photoreceptor drum 1M, at a close proximity to and above the right side of the intermediate image transfer belt 6 so that it is free to rotate, and a color C toner image is formed on it. In this example, the photoreceptor drum 1C is rotated in the counter-clockwise direction by a drive mechanism not shown in the figure. To the diagonally lower right side of the photoreceptor drum 1C is placed the charging unit 2C which charges the surface of the photoreceptor drum 1C to a prescribed voltage.

The writing unit 3C is provided almost by the side of and directly facing the photoreceptor drum 1C, and scans the previously charged photoreceptor drum 1C with a laser light beam for the color C having a prescribed intensity based on image data for the color C. This laser light beam is deflected and scanned, for example, by rotating a polygon mirror for the color C, which is the writing of the C color image data in the main scanning direction. The photoreceptor drum 1C rotates in the sub scanning direction. An electrostatic latent image for the color C is formed on the photoreceptor drum 1C because of this photoreceptor drum 1C rotating in the sub scanning direction and also the deflection and scanning of the laser light beam in the main scanning direction.

The developing unit 4C is provided above the writing unit 3C, and operates so as to develop the electrostatic latent image for the color C formed on the photoreceptor drum 1C. The developing unit 4C has a developing roller for the color C which is not shown in the figure. The toner and carrier for the color C are stored in the developing unit 4C. The developing roller for the color C has a magnet placed inside it, and rotates and conveys a two-component developer obtained by stirring the carrier and the color C toner inside the developing unit 4C to the opposing part of the photoreceptor drum 1C, and the electrostatic latent image is developed by the color C toner. This color C toner image formed on the photoreceptor drum 1C is transferred to the intermediate image transfer belt 6 by operating a primary transfer roller 7C (primary transfer). To the lower left side of the photoreceptor drum 1C is provided the cleaning section 8C which cleans the toner that is remaining on the photoreceptor drum 1C from the previous writing operation.

In this example, the image forming unit 10K is provided on the lower side of the image forming unit 10C. The image forming unit 10K has a photoreceptor drum 1K, a charging unit 2K, a writing unit 3K, a developing unit 4K, and a cleaning section 8K for the image forming member, and forms images of black (BK) color.

The photoreceptor drum 1K constitutes an example of an image carrier, and is placed, for example, on the lower side of the above photoreceptor drum 1C, at a close proximity to and above the right side of the intermediate image transfer belt 6 so that it is free to rotate, and a color BK toner image is formed on it. In this example, the photoreceptor drum 1K is rotated in the counter-clockwise direction by a drive mechanism not shown in the figure. To the diagonally lower right side of the photoreceptor drum 1K is placed the charging unit 2K which charges the surface of the photoreceptor drum 1K to a prescribed voltage. Scorotron charging electrodes are used in the above charging units 2Y, 2M, 2C, and 2K, and a DC voltage of a few hundred volts is applied to them.

The writing unit 3K is provided almost by the side of and directly facing the photoreceptor drum 1K, and scans the previously charged photoreceptor drum 1K with a laser light beam for the color BK having a prescribed intensity based on the image data for the color BK. This laser light beam is deflected and scanned, for example, by rotating a polygon mirror for the color BK, which is the writing of the BK color image data in the main scanning direction. The photoreceptor drum 1K rotates in the sub scanning direction. An electrostatic latent image for the color BK is formed on the photoreceptor drum 1K because of this photoreceptor drum 1K rotating in the sub scanning direction and also the deflection and scanning of the laser light beam in the main scanning direction.

The developing unit 4K is provided above the writing unit 3K, and operates so as to develop the electrostatic latent image for the color BK formed on the photoreceptor drum 1K. The developing unit 4K has a developing roller for the color BK which is not shown in the figure. The toner and carrier for the color BK are stored in the developing unit 4K. The developing roller for the color BK has a magnet placed inside it, and rotates and conveys a two-component developer obtained by stirring the carrier and the color BK toner inside the developing unit 4K to the opposing part of the photoreceptor drum 1K, and the electrostatic latent image is developed by the color BK toner. This color BK toner image formed on the photoreceptor drum 1K is transferred to the intermediate image transfer belt 6 by operating a primary transfer roller 7K (primary transfer).

To the lower left side of the photoreceptor drum 1K is provided the cleaning section 8K which cleans the toner that is remaining on the photoreceptor drum 1K from the previous writing operation. A primary transfer bias voltage with a polarity opposite to that of the toner used (positive polarity in the present preferred embodiment) is applied to the above primary transfer rollers 7Y, 7M, 7C, and 7K.

The intermediate image transfer belt 6 constitutes an example of an image carrier, and forms a color toner image (color image) by superimposing the toner images transferred by the primary transfer rollers 7Y, 7M, 7C, and 7K. For example, the color image formed on the intermediate image transfer belt 6 is conveyed towards a secondary transfer roller 7A by the intermediate image transfer belt 6 rotating in the clockwise direction. The secondary transfer roller 7A is positioned below the intermediate image transfer belt 6, and transfers together the color toner image formed on the intermediate image transfer belt 6 to the sheet P conveyed from a sheet feeding section 20 (secondary transfer).

The sheet feeding section 20, for example, is provided below the above writing unit 3K and is configured to have sheet feeding trays 20A, 20B, and 20C. The transfer sheets P stored in the sheet feeding trays 20A, 20B, and 20C are fed by discharge rollers 21 and sheet feeding rollers 22A provided in each of the sheet feeding trays 20A, 20B, and 20C, pass through conveying rollers 22B, 22C, and 22D, register rollers 23, and are conveyed to the secondary transfer roller 7A.

The fixing unit 17 is provided on the left side of the secondary transfer roller 7A, and carries out fixing processing of the transfer sheet P onto which a color image has been transferred. The fixing unit 17 has a fixing roller, a pressure roller, and a heater. In the fixing process, by passing the transfer sheet P between the fixing roller that is heated by the heater and the pressure roller whereby that transfer sheet P is subjected to heat and pressure. The transfer sheet P after fixing is gripped by discharge roller 24 and is placed on discharge tray 25 outside the apparatus.

In this example, a cleaning section 8A is provided on the upper left side of the intermediate image transfer belt 6, and carries out the cleaning operation of removing the toner remaining on the intermediate image transfer belt 6 after transfer. The cleaning section 8A has a discharging section that discharges the electric charge on the intermediate image transfer belt 6 and a pad that removes the toner remaining on the intermediate image transfer belt 6. The surface of the intermediate image transfer belt 6 is cleaned by this cleaning section 8A, and the intermediate image transfer belt 6 after discharging by the discharging section enters the next image forming cycle. Because of this, it is possible to form a color image on transfer sheet P.

On the upstream side of the cleaning section 8A of this copying machine main unit 101 are provided register sensors 12A and 12B (not shown in the figure) in a region in which it is possible to view the different edge parts of the top surface of the intermediate image transfer belt 6, detect the register marks CR of each of the colors Y, M, C, and BK for color misregistration correction formed on the two end sections of the intermediate image transfer belt 6 by the above image forming units 10Y, 10M, 10C, and 10K, and the image detection signals are generated. Based on these image detection signals, it is possible to execute the color misregistration complex correction mode and the color misregistration single correction mode.

In this example, immediately before the conveying rollers 22C and 22D is provided a transfer sheet width sensor 11 which is an example of a detection member, whereby the width of the transfer sheet P is detected, and a transfer sheet width signal S11 is output. The conveying rollers 22C and 22D are the part where the sheet feed conveying path from the manual feed tray 28 and the sheet feed conveying path from the sheet feeding section 20 meet. By placing the transfer sheet width sensor 11 at this position, it is possible to detect the width of a wide transfer sheet P' fed from the manual feed tray 28 as well as the width of a wide transfer sheet P' set in the sheet feeding tray 20A, 20B and 20C.

Figure 2:
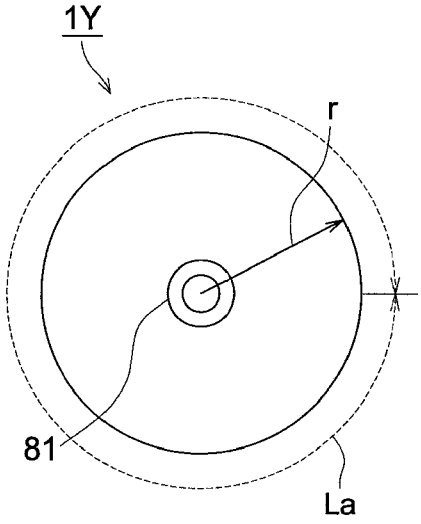
FIG. 2(A) to FIG. 2(C) are side view and front view diagrams showing an example of a configuration of a photoreceptor drum.
Figure 2:
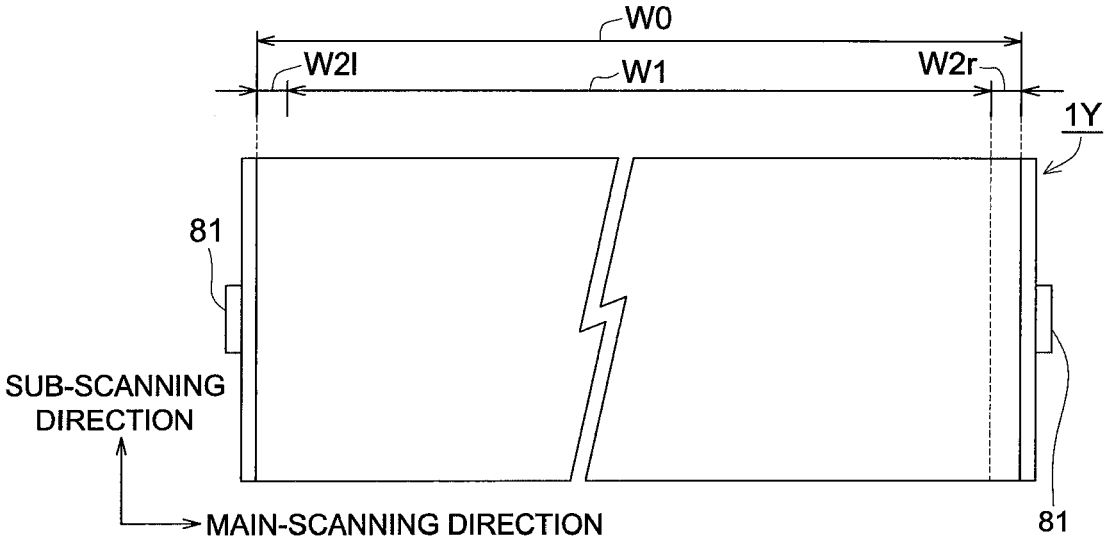
Figure 2:
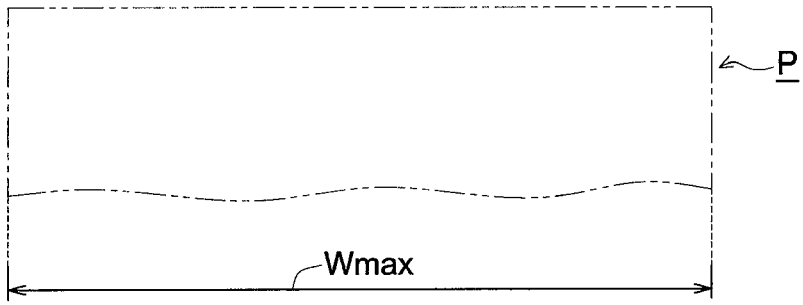

FIG. 2(A) to FIG. 2(C) are the side view and front view diagrams showing an example of the configuration of a photoreceptor drum 1Y. The photoreceptor drum 1Y shown in FIG. 2(A) is provided in the image forming unit 10Y, has a radius r, and the length of its periphery La is equal to 2.pi.r. The other photoreceptor drums 1M to 1K are also configured in a similar manner. Organic photoconductor (OPC) drums are used for the photoreceptor drums 1Y, 1M, 1C, and 1K.

The photoreceptor drum 1Y shown in FIG. 2(B) has an exposable width of W0. The exposable width W0 constitutes the width of the maximum image forming area along the main scanning direction. The exposable width W0 is almost equal to the laser scanning width of the writing unit 3Y, and, for example, the maximum image forming area is divided into an image area with a width of W1 (effective image area) and two non-image areas of widths W21 and W2*r*. The photoreceptor drum 1Y has a rotating shaft 81. When the main scanning direction is taken to be parallel to this rotating shaft 81, in the photoreceptor drum 1Y, at the left edge part of the image area of width W1 is provided the non-image area of width W21 and at the right edge part of the image area of width W1 is provided the non-image area of width W2*r*, and the image area of width W1 and the non-image areas of widths W21 and W2*r* are provided in parallel along the main scanning direction.

The image for transferring on to the transfer sheet P is formed in the image area of width W1. In the non-image areas of widths W21 and W2*r*, which are outside this image area of width W1, is formed the register mark CR of the color Y which is an example of an imprint image for color misregistration correction. The sub scanning direction is a direction at right angles to the rotating shaft 81 of the photoreceptor drum 1Y.

The exposable width W0 is given by the sum of the widths of the image area and the non-image areas (W1+W21+W2*r*), and in this example, the exposable width W0 has been set to be wider than the maximum width Wmax of the transfer sheet P shown in FIG. 2(C). An electrostatic latent image of the color Y is formed on the photoreceptor drum 1Y because of the rotation of the photoreceptor drum 1Y in the sub scanning direction and the deflection and scanning of the laser beam in the main scanning direction. The other photoreceptor drums 1M to 1K are also configured in a similar manner.

For example, in the photoreceptor drum 1M are provided an image area of width W1 and the non-image areas of widths W21 and W2*r* along the main scanning direction, and also, the exposable width W0 along the main scanning direction has been set to be larger than the maximum width Wmax of the transfer sheet P. In the photoreceptor drum 1C are provided an image area of width W1 and the non-image areas of widths W21 and W2*r* along the main scanning direction, and also, the exposable width W0 along the main scanning direction has been set to be larger than the maximum width Wmax of the transfer sheet P. In the photoreceptor drum 1K are provided an image area of width W1 and the non-image areas of widths W21 and W2*r* along the main scanning direction, and also, the exposable width W0 along the main scanning direction has been set to be larger than the maximum width Wmax of the transfer sheet P. Because of this, it is possible to execute the color misregistration complex correction mode and the color misregistration single correction mode.

Figure 3:
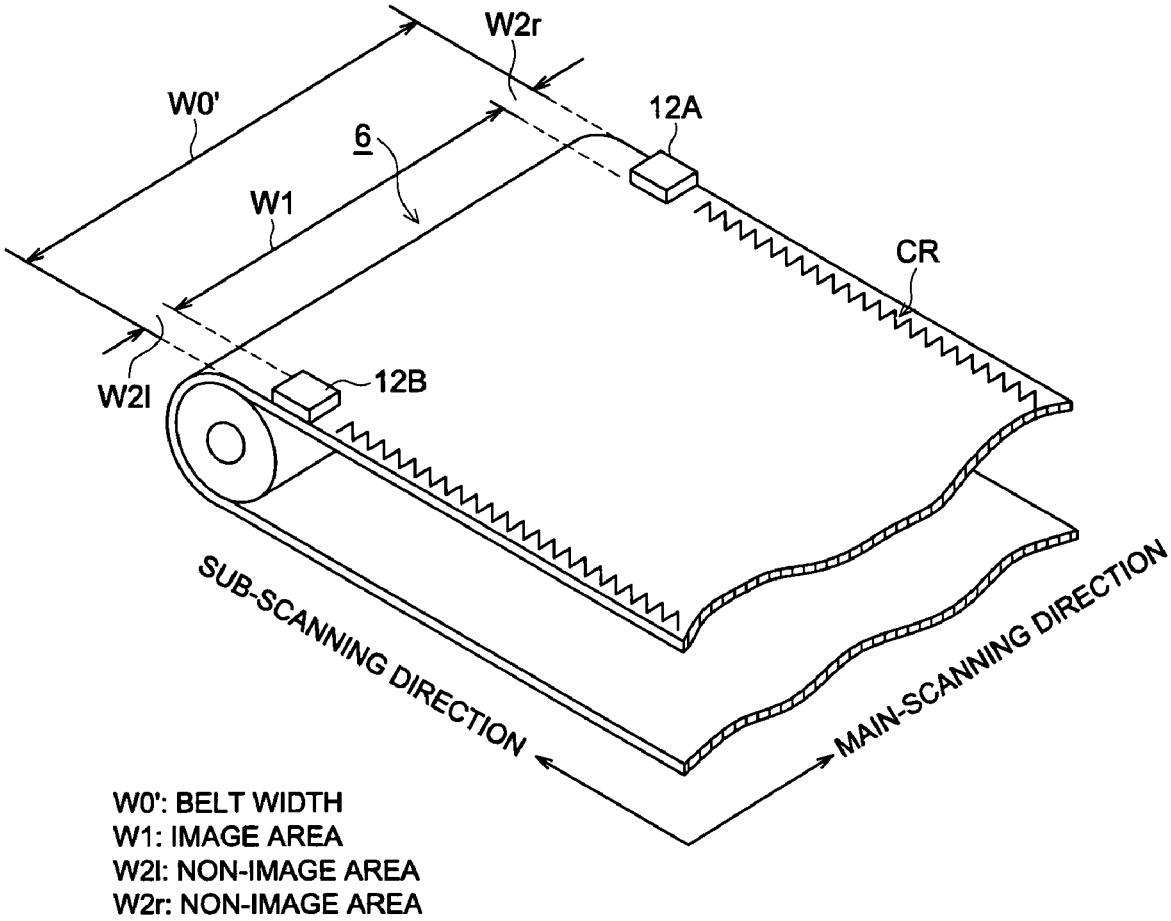
FIG. 3 is a perspective view diagram showing an example of detecting a register mark by two register sensors.

FIG. 3 is a perspective view diagram showing an example of detecting the register mark CR by two register sensors 12A and 12B. The register sensors 12A and 12B shown in FIG. 3 are placed in an area where the top surface of the intermediate image transfer belt 6 can be viewed and above the two end sections of the intermediate image transfer belt 6, and detect the register marks CR formed on the two sides of the intermediate image transfer belt 6 by the image forming units 10Y, 10C, 10M, and 10K, during the execution of the color misregistration complex correction mode and the color misregistration single correction mode. An optical type sensor or a line image sensor is used for the register sensors 12A and 12B. The register sensors 12A and 12B are placed above the non-image areas of widths W21 and W2*r*.

The intermediate image transfer belt 6 shown in FIG. 3 has, in order to transfer the toner images formed by the photoreceptor drums 1Y to 1K to the transfer sheet P not shown in the figure, a belt width W0' that is almost equal to the exposable width W0 of the photoreceptor drums 1Y to 1K. For example, the intermediate image transfer belt 6 has a belt width W0' that is wider than the short side of an A3 size transfer sheet P. Similar to that in the photoreceptor drums 1Y, an image area of width W1 and the non-image areas of widths W21 and W2*r* are provided along the main scanning direction, and also, the exposable width W0 along the main scanning direction has been set to be larger than the maximum width Wmax of the transfer sheet P.

Figure 4:
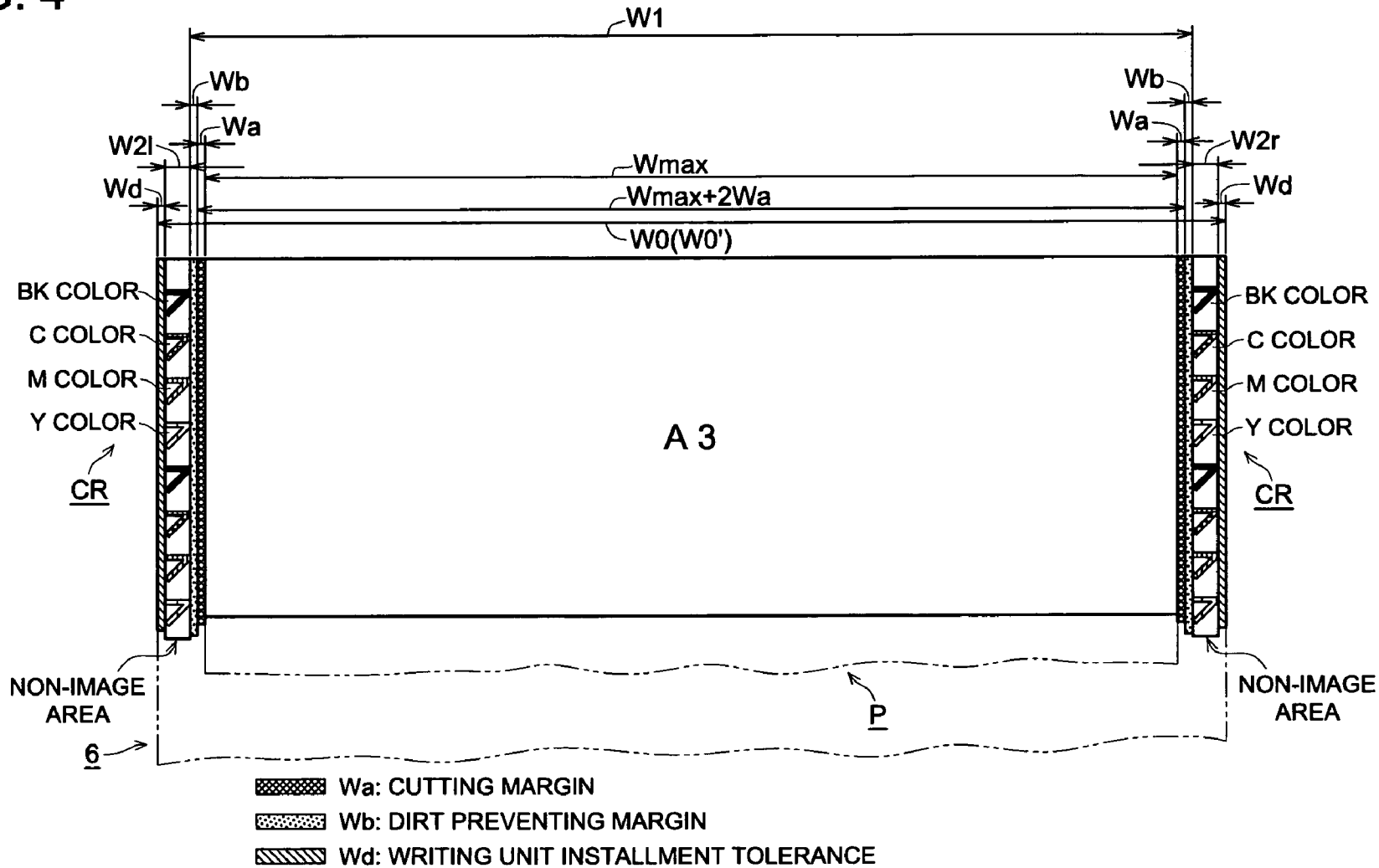
FIG. 4 is a top view diagram showing an example of feeding a sheet P on an intermediate image transfer belt.

FIG. 4 is a top view diagram showing an example of feeding the transfer sheet P on an intermediate image transfer belt 6. In this example, a case is shown of feeding (setting) an A3 size transfer sheet P with an intermediate image transfer belt 6 having a belt width W0' that is longer than the short side of an A3 size transfer sheet P.

In an intermediate image transfer belt 6 to which an A3 size transfer sheet P has been fed as shown in FIG. 4, when the exposable width is taken as W0 (=W0'), the width of the image area is taken as W1, and widths of the non-image areas are taken as W21 and W2*r*, left and right cutting margins (ranges) are taken as Wa, left and right dirt preventing margins are taken as Wb, left and right writing unit installment tolerances are taken as Wd, and the width of the short side of an A3 size transfer sheet P (the maximum width) is taken as Wmax=297 mm, the exposable width W0 is set (designed) to be W0=324 mm according to the specification values.

The width W1 of the image area is set to be Wmax+(Wa+Wb)×2. In this example, the left and right cutting margins Wa are set to 2 mm, the left and right dirt prevention margins Wb are also set to 2 mm, and the width of the image area W1 becomes 305 mm. The width W21 of the left end part of the non-image area is set to 8 mm, and the width W2*r* of the right end part of the non-image area is also set to 8 mm. The left and right writing unit installation tolerances Wd are set to 1.5 mm. Further, when carrying out main scanning correction, the line width of the register mark CR is set to 48 dots (1.016 mm).

In this example, when an ideal A3 sized transfer sheet P with a short side width of Wmax=297 mm is fed to the image forming system, since cutting margin widths of Wa=2 mm and dirt prevention margin widths Wb=2 mm have been set on both sides of the image area of width W1, it is possible to execute the color misregistration complex correction mode.

However, in the case of a photoreceptor drum 1Y' for which these cutting margins Wa or dirt preventing margins Wb have not been set, or even these cutting margins Wa and dirt prevention margins Wb have been set, and a transfer sheet P' of an A3' size whose short side exceeds the width Wmax is fed to the image forming system, it is not possible to execute the color misregistration complex correction mode. For example, when the left and right widths W21 and W2*r* of the non-image area are not present, the width W1 of the image area+(writing unit installation tolerance Wd)×2 becomes 308 mm. In this condition, if the color misregistration complex correction mode is attempted to be executed forcibly, the register marks CR of each of the colors Y, M, C, and BK for color misregistration correction will be transferred on to the two end parts of the transfer sheet P.

In this example, when the width Wmax of the transfer sheet P is wider that the width W1 of the image area, the color misregistration complex correction mode is not executed, but the color misregistration single correction mode is selected and executed. This is because it is considered very infrequent in an office apparatus to use specifications considering the elongation of a transfer sheet P of A3 size. In the case of such settings (specifications), the color misregistration correction processing is executed after switching from the color misregistration complex correction mode (job-continuing register correction mode) to the color misregistration single correction mode (job-stopping register correction mode). When a transfer sheet P with a width smaller than the width W1 of the image area is selected, the color misregistration complex correction mode is selected and the color misregistration correction processing is executed. In the color misregistration complex correction mode, the amount of color misregistration is detected continuously during the printing operation, and the write starting position (write timing) of the writing unit is corrected.

In the color misregistration complex correction mode, the speed deviation is measured with the color BK as the reference, and correction is made for the amount of misregistrations in the respective ranges. For example, the register marks CR for color misregistration correction are formed on the intermediate image transfer belt 6 via the photoreceptor drums 1Y, 1M, 1C, and 1K, the timing of passing of these register marks is read out, and the amount of displacement of the register marks of other colors with respect to the register mark of the reference color is calculated, and based on this amount of position displacement, the position of image forming is corrected. The position of image forming is, when a color image is reproduced on the intermediate image transfer belt 6 based on the image data, the position at which the toner images of each of the colors Y, M, C, and BK are superimposed. This position of image forming is corrected by adjusting the write starting position for the photoreceptor drums 1Y, 1M, 1C, and 1K. The timing of making the correction is in units of one page. By carrying out the operations in this manner, there is no possibility of the register marks CR of each of the colors Y, M, C, and BK for color misregistration correction being transferred on to the two end parts of the transfer sheet P.

Figure 5:
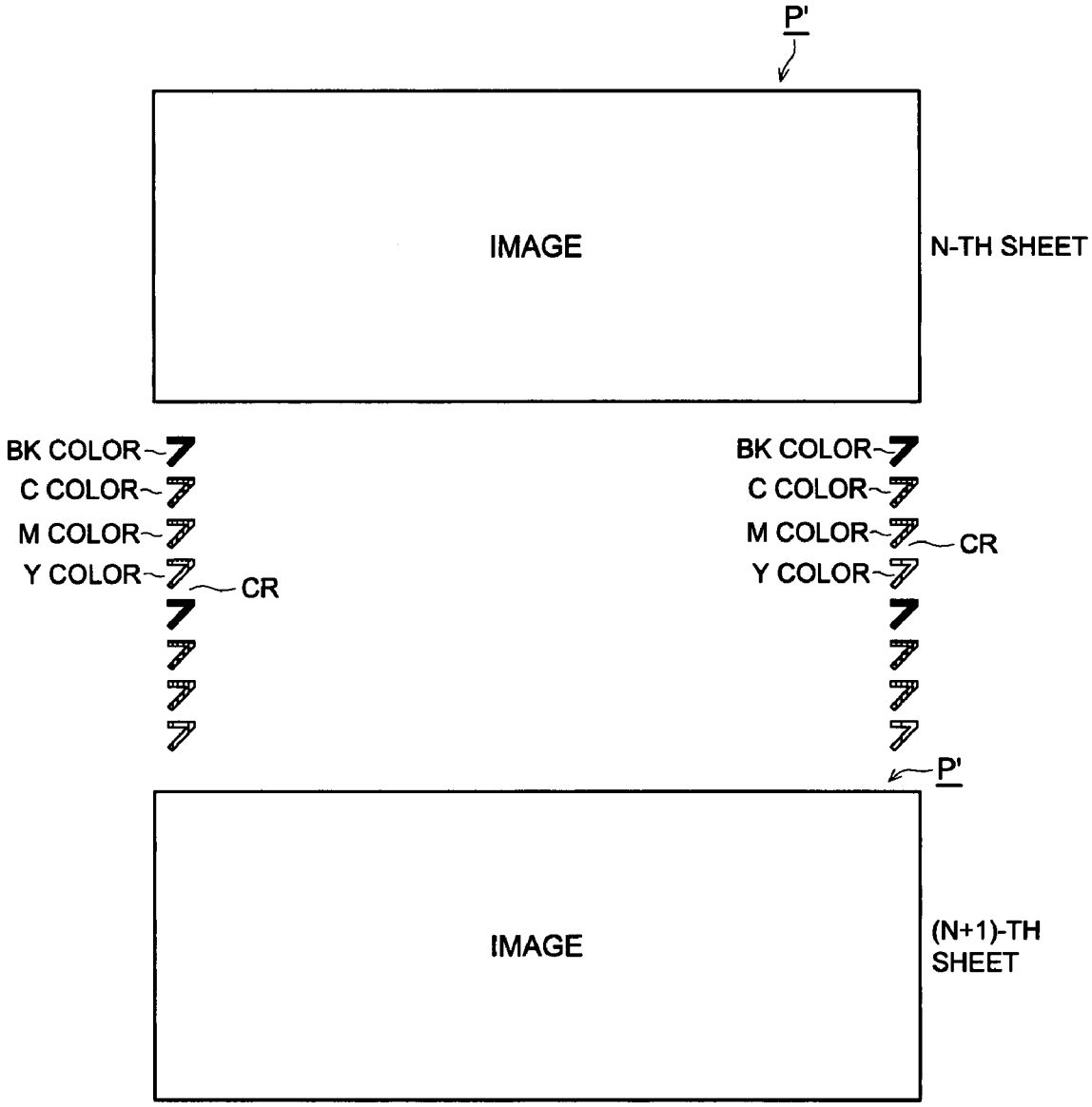
FIG. 5 is a schematic diagram showing an example of forming the register mark during color misregistration single correction mode.

FIG. 5 is a schematic diagram showing an example of forming the register mark CR during color misregistration single correction mode.

According to the color misregistration single correction mode shown in FIG. 5, when a transfer sheet P' of A3' size that is wider than an A3 size transfer sheet is fed into the image forming system, for example, after the formation of the Nth image is completed, the job of the (N+1)th image is stopped, and the color misregistration correction processing (color misregistration single correction mode) is executed.

In the color misregistration single correction mode, the job is stopped, the speed deviation is measured taking the color BK as the reference, and correction is made in the respective regions for the amount of misregistration. For example, the register marks CR for color misregistration correction are formed on the intermediate image transfer belt 6 via the photoreceptor drums 1Y, 1M, 1C, and 1K. At this time, one pair of sawtooth shaped color BK register marks for color misregistration correction is formed on the intermediate image transfer belt 6 at its left and right ends with its direction of movement being the sub scanning direction, and subsequently, one pair of color C register marks each is formed at the left and right ends, after which one pair of color M register marks each is formed at the left and right ends, and then one pair of color Y register marks each is formed at the left and right ends. Herein, "the sawtooth shaped mark" has a first line segment parallel to the main scanning direction and a second line segment connected to one end of the first line segment, the second line segment having a prescribed angle to the first line segment. The reason for forming the register marks CR of each of the colors at the left and right ends with four of the colors K, C, M, and Y as one group is to detect the image forming positions of the register marks CR of each color while suppressing the toner consumption, and to correct the positions accurately.

Thereafter, the timing of passing of these register marks CR is read out, and the amount of displacement of the register marks CR of other colors with respect to the register mark CR of the reference color is calculated, and based on this amount of position displacement, the position of image forming is corrected. When this color misregistration correction processing is completed, the job of the (N+1)th image is executed. Using the width W1 of the image area, the image is formed on a transfer sheet P' of an A3' size that is wider than a transfer sheet of A3 size.

Figure 6:
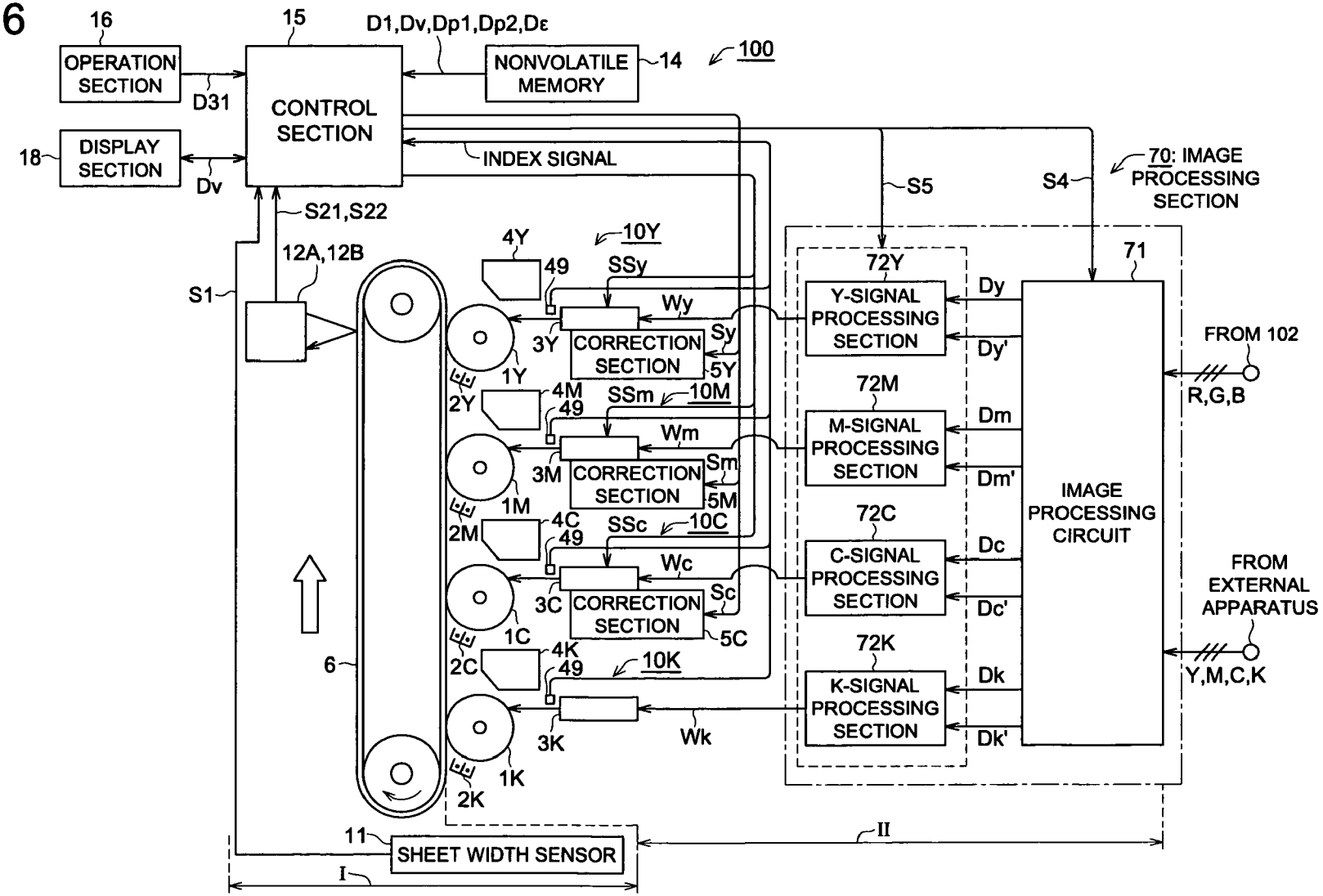
FIG. 6 is a block diagram showing an example of the configuration of an image transfer system and an image forming system of the color copying machine.

FIG. 6 is a block diagram showing an example of the configuration of an image transfer system I and an image forming system II of the color copying machine 100. The color copying machine 100 shown in FIG. 6 is one in which the processing system that includes the intermediate image transfer belt 6 shown in FIG. 1, the transfer sheet width sensor 11, the register sensors 12A and 12B are extracted as the image transfer system I, and the image forming units 10Y, 10M, 10C, and 10K are extracted as the image forming system II.

In FIG. 6, the color copying machine 100 has the image forming units 10Y, 10M, 10C, and 10K, the transfer sheet width sensor 11, the register sensors 12A and 12B, a nonvolatile memory 14, a control section 15, an operation section 16, a display section 18, and an image processing section 70.

The transfer sheet width sensor 11 is connected to the control section 15 so that the width of the transfer sheet P fed to the image transfer system I is detected and the transfer sheet width signal S1 (transfer sheet width information) is output to the control section 15. A line image sensor is used for the transfer sheet width sensor 11. Apart from the transfer sheet width sensor 11 provided in the middle of the conveying path, the detection section can also be made to detect the width Wmax of the transfer sheet P using a transfer sheet width sensor 11 provided inside the sheet feeding tray. Any method can be used as long as the detection section can detect a wide transfer sheet P'.

Using the control section 15, the image forming units 10Y, 10M, 10C, and 10K are controlled based on the transfer sheet width data D1 which is analog to digital converted from the transfer sheet width signal S1 output from the transfer sheet width sensor 11. For example, one of the color misregistration complex correction mode and the color misregistration single correction mode is selected based on the transfer sheet width data D1. In this example, the control section 15 detects the width Wmax of the transfer sheet P based on the transfer sheet width data D1. After that, the control section 15 compares the image area width information with the transfer sheet width data D1, and, if the width Dmax of the transfer sheet P is smaller than the width W1 of the image area, it selects the color misregistration complex correction mode, or selects the color misregistration single correction mode if the width Dmax of the transfer sheet P is larger than the width W1 of the image area. The width information is the digital data obtained by binarizing the width W1 of the image area.

In the color misregistration complex correction mode, the control section 15 executes in parallel the processing of writing the image in the image area of width W1 and the processing of writing the register marks CR in the non-image areas of width W21 and W2*r*. In the color misregistration single correction mode, the processing of writing the image in the image area of width W1 is interrupted and only the processing of writing the register marks CR in the non-image areas of width W21 and W2*r* is executed.

In this example, the control section 15 executes the color misregistration correction processing when the fixing temperature of the fixing unit 17 changes and the temperature difference becomes Δ2° C., when the image forming units 10Y, 10M, 10C, and 10K have stopped for a specific period of time, when the main power supply is turned ON, or when a forcible correction instruction is given by the user. In this example, the control section 15 executes the color misregistration correction processing for each type including size of the transfer sheet.

The register sensors 12A and 12B are connected to the control section 15, and during the execution of the color misregistration complex correction mode or the color misregistration single correction mode, they detect the register marks CR formed on the two side end parts on the intermediate image transfer belt 6 and output the image detection signals S21 and S22. The leading edge detection signal component and the trailing edge detection signal component are included in the image detection signals S21 and S22.

Reflecting type optical sensors or image sensors are used for the register sensors 12A and 12B. Light emitting devices and light receiving devices are provided in these sensors, and the light from the light emitting device is incident on the register marks CR and the light reflected from it is detected by the light receiving device. The control section 15 controls the exposure timings of the writing units 3Y, 3M, and 3C based on the image detection data Dp1 and Dp2 obtained after analog to digital converting the image detection signals S21 and S22 acquired from the register sensors 12A and 12B.

The operation section 16 is connected to the control section 15, and the image formation conditions during normal printing mode or the operation data D31 instructing a forced color misregistration correction input by the user are input from this operation section 16. The operations are made by the user. Apart from the operation section 16, the display section 18 is connected to the control section 15, and for example, the details of the color misregistration correction processing is displayed in it based on the display data Dv at the time of forcibly instructing a correction. A liquid crystal display is used in the display section 18, and the liquid crystal display is used in combination with a touch panel not shown in the figure that constitutes the operation section 16.

Apart from the operation section 16, the nonvolatile memory 14 is connected to the control section 15. The transfer sheet width data D1, the image detection data Dp1 and Dp2, the color misregistration correction data De, the display data Dv, and the like, are stored in the nonvolatile memory 14. A hard disk drive or an EEPROM is used for the nonvolatile memory.

Apart from the nonvolatile memory 14, the image processing section 70 is connected to the above control section 15. The image processing section 70 has an image processing circuit 71, a Y-signal processing section 72Y, a M-signal processing section 72M, a C-signal processing section 72C, and a K-signal processing section 72K. The R, G, and B signals related to the R, G, and B color components of the color image read from the document, and the Y, M, C, and K signals related to any print that are output from an external equipment such as a printer are input to the image processing circuit 71.

In the image processing circuit 71, based on the image processing control signal S4, the R, G, and B signals are color converted and image data Dy is output to the Y-signal processing section 72Y. Further, at the time of selecting the color misregistration complex correction mode or the color misregistration single correction mode, image data Dy' for color misregistration correction is output to the Y-signal processing section 72Y based on the image processing control signal S4. Here, the image data Dy is the image formation signal after analog to digital conversion for the color Y related to a job in the normal image formation mode. The image data Dy' is the data for forming the register mark CR of the color Y.

In a similar manner, in the image processing circuit 71, based on the image processing control signal S4, the R, G, and B signals are color converted and image data Dm is output to the M-signal processing section 72M. Further, at the time of selecting the color misregistration complex correction mode or the color misregistration single correction mode, image data Dm' for color misregistration correction is output to the M-signal processing section 72M based on the image processing control signal S4. Here, the image data Dm is the image formation signal after analog to digital conversion for the color M related to a job in the normal image formation mode. The image data Dm' is the data for forming the register mark CR of the color M.

Further, in the image processing circuit 71, based on the image processing control signal S4, the R, G, and B signals are color converted and image data Dc is output to the C-signal processing section 72C. Further, at the time of selecting the color misregistration complex correction mode or the color misregistration single correction mode, image data Dc' for color misregistration correction is output to the C-signal processing section 72C based on the image processing control signal S4. Here, the image data Dc is the image formation signal after analog to digital conversion for the color C related to a job in the normal image formation mode. The image data Dc' is the data for forming the register mark CR of the color C.

Further, in the image processing circuit 71, based on the image processing control signal S4, the R, G, and B signals are color converted and image data Dk is output to the K-signal processing section 72K. Further, at the time of selecting the color misregistration complex correction mode or the color misregistration single correction mode, image data Dk' for color misregistration correction is output to the K-signal processing section 72K based on the image processing control signal S4. Here, the image data Dk is the image formation signal after analog to digital conversion for the color BK related to a job in the normal image formation mode. The image data Dk' is the data for forming the register mark CR of the color BK. The image processing control signal S4 is output from the control section 15 to the image processing circuit 71.

The Y-signal processing section 72Y selects the image data Dy and/or the image data Dy' based on a write selection signal S5, and outputs this image data Dy and/or the image data Dy' to the writing unit 3Y. The writing unit 3Y detects the irradiation timing of the laser beam for the color Y and outputs the laser detection signal (hereinafter referred to as the Y-index signal).

The M-signal processing section 72M selects the image data Dm and/or the image data Dm' based on the write selection signal S5, and outputs this image data Dm and/or the image data Dm' to the writing unit 3M. The writing unit 3M detects the irradiation timing of the laser beam for the color M and outputs the laser detection signal (hereinafter referred to as the M-index signal).

The C-signal processing section 72C selects the image data Dc and/or the image data Dc' based on the write selection signal S5, and outputs this image data Dc and/or the image data Dc' to the writing unit 3C. The writing unit 3C detects the irradiation timing of the laser beam for the color C and outputs the laser detection signal (hereinafter referred to as the C-index signal).

The K-signal processing section 72K selects the image data Dk and/or the image data Dk' based on the write selection signal S5, and outputs this image data Dk and/or the image data Dk' to the writing unit 3K. The writing unit 3K detects the irradiation timing of the laser beam for the color K and outputs the laser detection signal (hereinafter referred to as the K-index signal). The write selection signal S5 is output from the control section 15 to each of the Y-signal to K-signal processing sections 72Y to 72K.

Apart from the image processing section 70, the image forming units 10Y, 10M, 10C, and 10K are connected to the control section 15, and in the image forming unit 10Y, a toner image of the color Y is formed on the intermediate image transfer belt 6 via the photoreceptor drum 1Y based on write data Wy for the color Y output from the image processing section 70. In the write data Wy are included the image data Dy during the normal image forming mode, or the image data Dy' for forming the register marks CR during the color misregistration correction mode.

In this example, when the color misregistration complex correction mode is selected, the write data Wy=image data Dy+image data Dy' is output to the write unit 3Y. In other words, the image data Dy of normal image formation that has to be written in the image area of width W1 and the image data Dy' for color misregistration correction to be written in the non-image areas of widths W21 and W2*r* on its two sides are synthesized in a serial manner in the Y-signal processing section 72Y and are output to the writing unit 3Y.

Further, if the color misregistration single correction mode is selected, the write data Wy=image data Dy' is output to the write unit 3Y. In other words, the image data Dy of normal image formation that has to be written in the image area of width W1 is saved in the temporary memory area, and only the image data Dy' for color misregistration correction to be written in the non-image areas of widths W21 and W2*r* on its two sides is selected by the Y-signal processing section 72Y and is output to the writing unit 3Y.

In the image forming unit 10M, a toner image of the color M is formed on the intermediate image transfer belt 6 via the photoreceptor drum 1M based on write data Wm for the color M output from the image processing section 70. In the write data Wm are included the image data Dm during the normal image forming mode, or the image data Dm' for forming the register marks CR during the color misregistration correction mode.

Even in the image forming unit 10M, when the color misregistration complex correction mode is selected, the write data Wm=image data Dm+image data Dm' is output to the write unit 3M. In other words, the image data Dm of normal image formation that has to be written in the image area of width W1 and the image data Dm' for color misregistration correction to be written in the non-image areas of widths W21 and W2*r* on its two sides are synthesized in a serial manner in the M-signal processing section 72M and are output to the writing unit 3M.

Further, if the color misregistration single correction mode is selected, the write data Wm=image data Dm' is output to the write unit 3M. In other words, the image data Dm of normal image formation that has to be written in the image area of width W1 is saved in the temporary memory area, and only the image data Dm' for color misregistration correction to be written in the non-image areas of widths W21 and W2*r* on its two sides is selected by the M-signal processing section 72M and is output to the writing unit 3M.

In the image forming unit 10C, a toner image of the color C is formed on the intermediate image transfer belt 6 via the photoreceptor drum 1C based on write data Wc for the color C output from the image processing section 70. In the write data Wc are included the image data Dc during the normal image forming mode, or the image data Dc' for forming the register marks CR during the color misregistration correction mode.

Even in the image forming unit 10C, when the color misregistration complex correction mode is selected, the write data Wc=image data Dc+image data Dc' is output to the write unit 3C. In other words, the image data Dc of normal image formation that has to be written in the image area of width W1 and the image data Dc' for color misregistration correction to be written in the non-image areas of widths W21 and W2*r* on its two sides are synthesized in a serial manner in the C-signal processing section 72C and are output to the writing unit 3C.

Further, if the color misregistration single correction mode is selected, the write data Wc=image data Dc' is output to the write unit 3C. In other words, the image data Dc of normal image formation that has to be written in the image area of width W1 is saved in the temporary memory area, and only the image data Dc' for color misregistration correction to be written in the non-image areas of widths W21 and W2*r* on its two sides is selected by the C-signal processing section 72C and is output to the writing unit 3C.

In the image forming unit 10K, a toner image of the color BK is formed on the intermediate image transfer belt 6 via the photoreceptor drum 1K based on write data Wk for the color BK output from the image processing section 70. In the write data Wk are included the image data Dk during the normal image forming mode, or the image data Dk' for forming the register marks CR during the color misregistration correction mode.

Even in the image forming unit 10K, when the color misregistration complex correction mode is selected, the write data Wk=image data Dk+image data Dk' is output to the write unit 3K. In other words, the image data Dk of normal image formation that has to be written in the image area of width W1 and the image data Dk' for color misregistration correction to be written in the non-image areas of widths W21 and W2*r* on its two sides are synthesized in a serial manner in the BK-signal processing section 72K and are output to the writing unit 3K.

Further, if the color misregistration single correction mode is selected, the write data Wk=image data Dk' is output to the write unit 3K. In other words, the image data Dk of normal image formation that has to be written in the image area of width W1 is saved in the temporary memory area, and only the image data Dk' for color misregistration correction to be written in the non-image areas of widths W21 and W2*r* on its two sides is selected by the K-signal processing section 72K and is output to the writing unit 3K.

In the writing units 3Y, 3M, 3C, and 3K, control is carried out by the control section 15 so that the register marks CR for color misregistration correction are formed on the intermediate image transfer belt 6 via the photoreceptor drums 1Y, 1M, 1C, and 1K. In this example, at the time of detecting the mark width of the register marks CR formed on the intermediate image transfer belt 6, the control section 15 detects the instant of time of detecting the leading edge and the instant of time of detecting the trailing edge of the register marks CR on the intermediate image transfer belt 6 taking as reference the write start signal (hereinafter referred to as the VTOP signal) that permits the starting of writing the register mark CR to the photoreceptor drums 1Y, 1M, 1C, or 1K, and calculates the color misregistration correction data De based on the instant of time of detecting the leading edge and the instant of time of detecting the trailing edge of the register marks CR.

In this example, a correction section 5Y has been mounted to the writing unit 3Y for the color Y, and this adjusts the inclination of the horizontal position of that writing unit 3Y based on a unit position correction signal Sy from the control section 15. In a similar manner, a correction section 5M has been mounted to the writing unit 3M for the color M, and this adjusts the inclination of the horizontal position of that writing unit 3M based on a unit position correction signal Sm from the control section 15. A correction section 5C has been mounted to the writing unit 3C for the color C, and this adjusts the inclination of the horizontal position of that writing unit 3C based on a unit position correction signal Sc from the control section 15 (partial lateral magnification correction processing).

In the calculation of the amount of color misregistration in this example, the register mark CR for the color BK is being taken as the reference. This is for adjusting the writing positions of the color images of the colors Y, M, and C to that of the color BK. For example, for adjustment of the writing position of the color Y image, the position of writing the register mark CR for the color BK and the position of writing the register mark CR for the color Y are detected, and the correction amount for that is calculated from the amount of displacement between the position of writing the register mark CR for the color Y and the position of writing the register mark CR for the color BK. In a similar manner, the even for adjustment of the writing positions of images of the colors M and C, the displacements between the position of writing the register mark CR for the color BK and the positions of writing the register marks CR for the colors M and C are detected respectively, and the respective correction amounts for them are calculated from these amounts of displacement. After that, the positions of forming the images of the colors Y, M, and C are adjusted.

Figure 7:
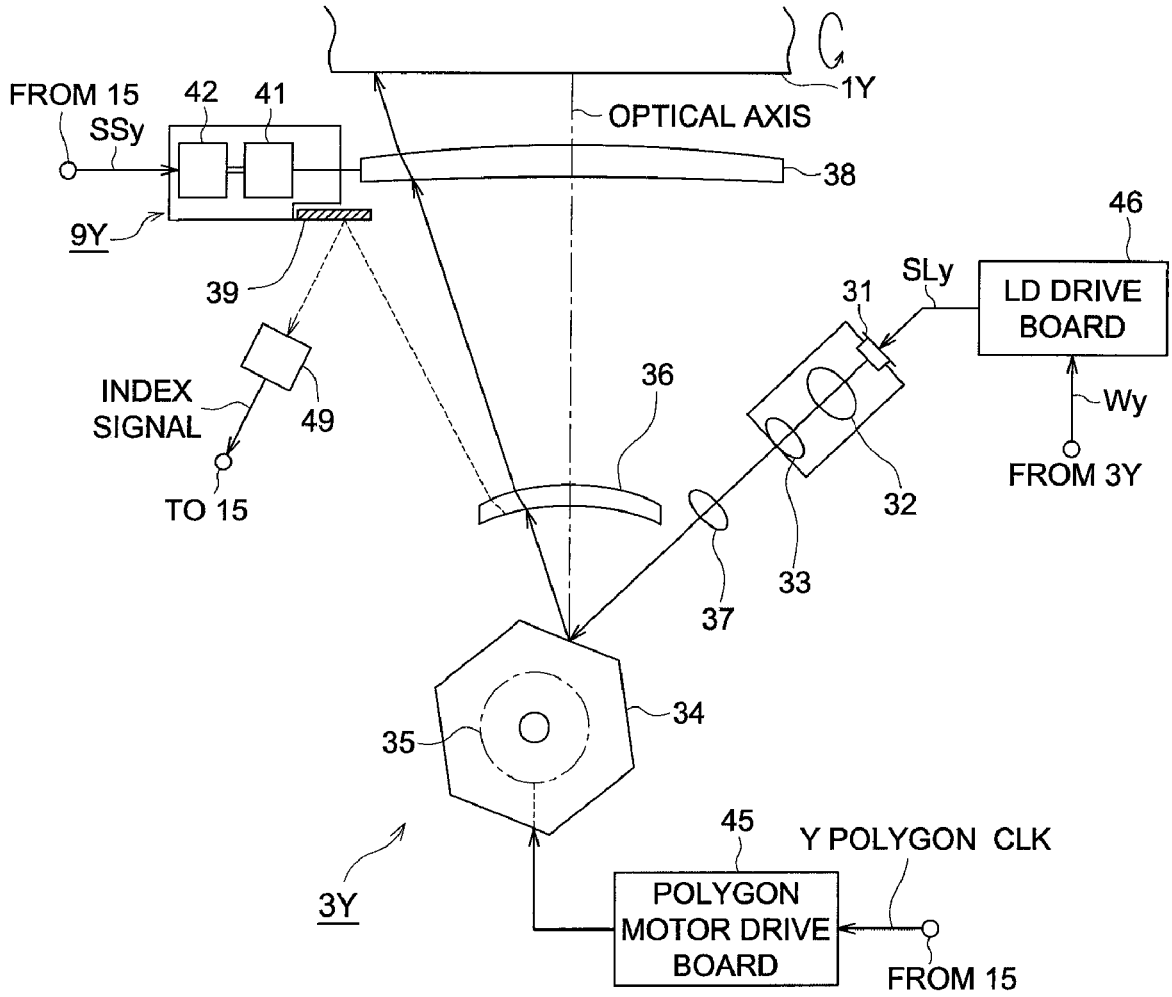
FIG. 7 is a schematic diagram showing an example of a configuration of a writing unit and a skew adjustment section for the color yellow.

FIG. 7 is a schematic diagram showing an example of a configuration of the writing unit 3Y and a skew adjustment section 9Y for the color Y. The writing unit 3Y for the color Y shown in FIG. 7 has a semiconductor laser light source 31, a collimator lens 32, an auxiliary lens 33, a polygon mirror 34, a polygon motor 35, an f(.theta.) lens 36, a CY1 lens 37 for mirror surface image focusing, a CY2 lens 38 for drum surface image focusing, a reflecting plate 39, a polygon motor drive board 45, and an LD drive board 46.

The semiconductor laser light source 31 is connected to the LD drive board 46 for the color Y. The write data Wy from the writing unit 3Y is supplied to the LD drive board 46. When the color misregistration complex correction mode is selected, the write data Wy=image data Dy+image data Dy' is output to the writing unit 3Y. When the color misregistration single correction mode is selected, the write data Wy=image data Dy' is output to the writing unit 3Y. In the LD drive board 46, the write data Wy is PWM modulated, and a laser drive signal SLy with a prescribed pulse width after PWM modulation is output to the semiconductor laser light source 31. In the semiconductor laser light source 31, laser light is generated based on the laser drive signal SLy for the color Y. The laser light emitted from the semiconductor laser light source 31 is formed into a prescribed beam of light by the collimator lens 32, auxiliary lens 33, and the CY1 lens 37.

This light beam is deflected along the main scanning direction by the polygon mirror 34. For example, the polygon mirror 34 is driven by the polygon motor 35. The polygon motor drive board 45 is connected to the polygon motor 35, and a Y polygon clock CLK is supplied to the polygon motor drive board 45 from the control section 15 described earlier. Based on the Y polygon clock CLK, the polygon motor drive board 45 rotates the polygon mirror 34 at a prescribed rotational speed. The light beam deflected by the polygon mirror 34 is focused on the photoreceptor drum 1Y by the f(θ) lens 36 and the CY2 lens 38. Because of this operation, the register marks CR for color misregistration correction are formed in the non-image areas at the left and right end parts of the photoreceptor drum 1Y during the color misregistration complex correction mode, and an electrostatic latent image of the original document image is formed in the image area.

The skew adjustment section 9Y is provided in this writing unit 3Y. The skew adjustment section 9Y is installed in the main unit section. The reflecting plate 39 is provided in this main unit section, and at a position directly opposite this reflecting plate 39 is installed a laser index sensor 49. The laser index sensor 49 detects the beam of light that is deflected by the polygon mirror 34, and outputs the Y-index signal to the control section 15.

The skew adjustment section 9Y has an adjustment gear unit 41 and a motor 42 for adjustment. The CY2 lens 38 is mounted on the adjustment gear unit 41. The adjustment gear unit 41 is mounted so that it is free to move with respect to the CY2 lens 38. Using the motor 42 for adjustment, the adjustment gear unit 41 is adjusted by moving in the vertical direction based on a skew adjustment signal SSy. However, the explanations of the examples of configurations of the writing units 3M, 3C, and 3K and their skew adjustment sections will be omitted here.

The calculation of the amount of displacement in this example is made taking the register mark CR for the color BK as the reference. This is for adjusting so that the writing positions of the color images of the colors Y, M, and C to match with that of the color BK. The contents of the correction processings are, for example, those given in items i to v below. Among the contents of the correction processing, the items i to iii are realized by correcting the image data, and iv and v are realized by driving the motor 42, actually, adjusted by driving the writing units 3Y, 3M, 3C, and 3K.

(i). Main Scanning Correction Processing

This processing is that of correcting so as to make identical the starting positions along the main scanning direction of writing the color images of the colors Y, M, C, and BK. For example, regarding correcting the position of writing for the color Y, from the image detection data Dp1 and Dp2 of the register mark CR of the color BK and the image detection data Dp1 and Dp2 of the register mark CR of the color Y, the amount of displacement of the position along the main scanning direction of the color Y with respect to the color BK is obtained, and the correction amount is obtained from the position displacement amount obtained here. Based on this correction amount, the writing timing along the main scanning direction is adjusted for the colors Y, M, and C so that the writing positions of the colors Y, M, and C are identical to the writing position of the color BK.

(ii). Sub Scanning Correction Processing

This processing is that of correcting so as to make identical the starting positions along the sub scanning direction of writing the color images of the colors Y, M, C, and BK. For example, regarding correcting the position of writing for the color Y, from the image detection data Dp1 and Dp2 of the register mark CR of the color BK and the image detection data Dp1 and Dp2 of the register mark CR of the color Y, the amount of displacement of the position along the sub scanning direction of the color Y with respect to the color BK is obtained, and the correction amount is obtained from the position displacement amount obtained here. Based on this correction amount, the writing timing along the sub scanning direction is adjusted for the colors Y, M, and C so that the writing positions of the colors Y, M, and C are identical to the writing position of the color BK.

(iii). Overall Lateral Magnification Correction Processing

This processing is that of aligning the overall image forming positions of the color images of the colors Y, M, C, and BK. For example, by adjusting the period of the image clock signal, the timing of emission of laser light is adjusted, and based on this adjustment, the total lateral magnification displacement amount is corrected.

(iv). Partial Lateral Magnification Correction Processing

This processing is that of adjusting the inclinations of the horizontal positions of each of the writing units 3Y, 3M, 3C, and 3K. For example, one side along the horizontal direction of the writing unit 3Y is fixed to the main unit section while the other side is made movable, and, using the correction section 5Y for the color Y shown in FIG. 6, a motor not shown in the figure is rotated based on the position correction signal Sy thereby driving the adjustment gear unit 41, thereby adjusting the inclination in the X-Y (horizontal) direction of the writing unit 3Y. This is for adjusting the inclination of the horizontal position of the writing unit 3Y with respect to the photoreceptor drum 1Y. Similar processing is done also in the other image forming units 10M and 10C.

(v). Skew Correction Processing

This processing is the correction of adjusting the inclinations of the vertical positions of the CY2 lens 38 inside each of the writing units 3Y, 3M, 3C, and 3K. For example, one side of the CY2 lens 38 is supported in a fixed manner by the writing unit 3Y and the other side is made free to move up and down, the motor 42 in the skew adjustment section 9Y for the color Y shown in FIG. 7 drives the adjustment gear unit 41 based on the skew adjustment signal SSy, thereby the CY2 lens 38 is adjusted by moving in the vertical direction. This is for adjusting the inclination of the vertical position of the CY2 lens 38 with respect to the photoreceptor drum 1Y. Similar processing is done also in the other image forming units 10M and 10C.

Figure 8:
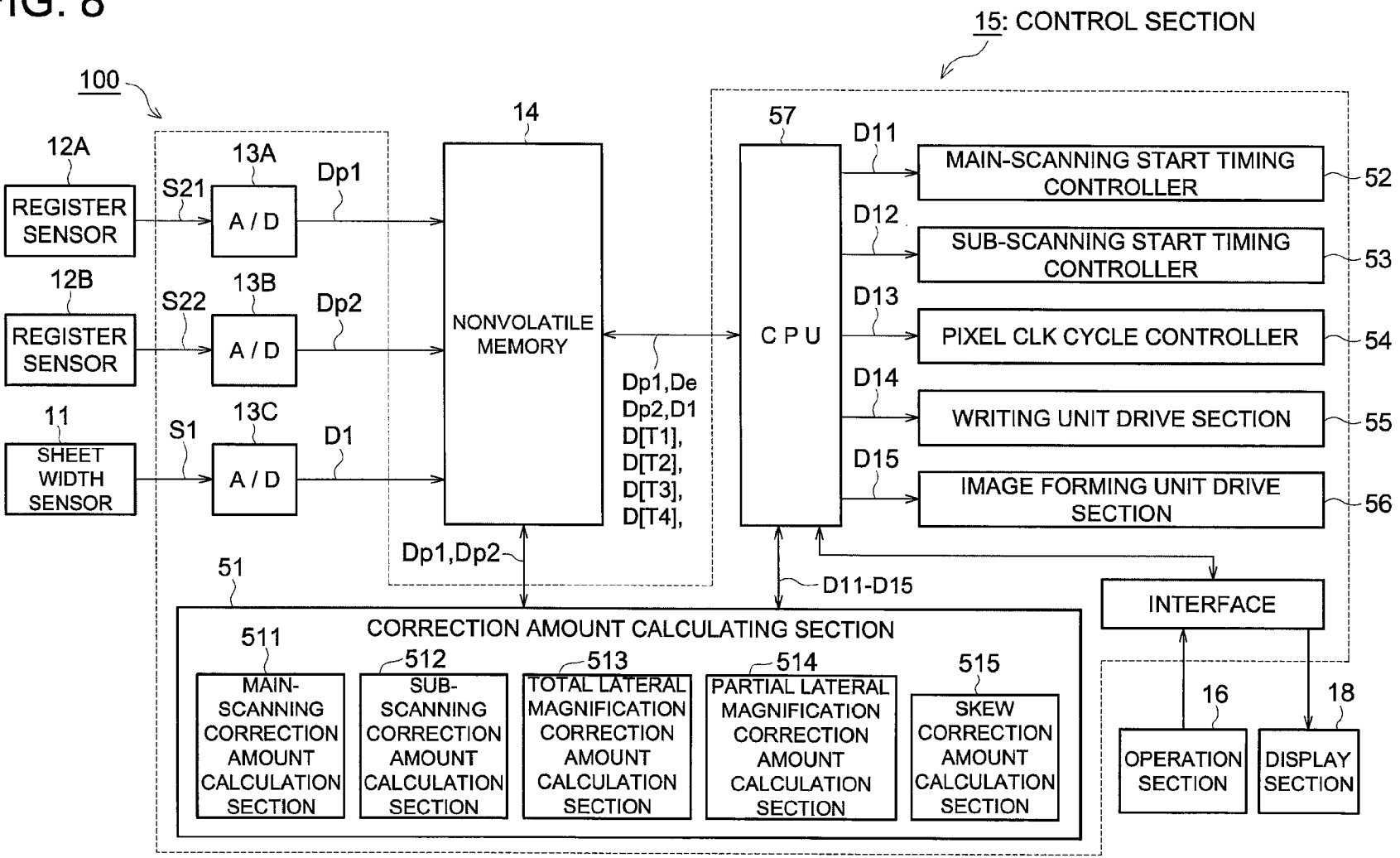
FIG. 8 is a block diagram supplementing an example of a configuration of a control system of the color copying machine.

FIG. 8 is a block diagram supplementing the example of configuration of the control system of the color copying machine 100. The color copying machine 100 shown in FIG. 8 has a transfer sheet width sensor 11, two register sensors 12A and 12B, a nonvolatile memory 14, a control section 15, an operation section 16, and a display section 18. The control section 15, for example, has A/D converters 13A to 13C, a correction amount calculating section 51, a main scanning start timing controller 52, a sub scanning start timing controller 53, a pixel clock cycle controller 54, a writing unit drive section 55, an image forming unit drive section 56, and a CPU 57.

The transfer sheet width sensor 11 is connected to the A/D converter 13C. In the A/D converter 13C, during the color misregistration complex correction mode or during the color misregistration single correction mode, the transfer sheet width data D1 is output after A/D converting and binarizing the transfer sheet width signal S1 output from the transfer sheet width sensor 11.

The register sensor 12A is connected to the A/D converter 13A. In the A/D converter 13A, during the color misregistration complex correction mode or during the color misregistration single correction mode, the image detection data Dp1 is output after A/D converting and binarizing the image detection signal S21 output from the register sensor 12A.

The register sensor 12B is connected to the A/D converter 13B. In the A/D converter 13B, during the color misregistration complex correction mode or during the color misregistration single correction mode, the image detection data Dp2 is output after A/D converting and binarizing the image detection signal S22 output from the register sensor 12B. The A/D converters 13A to 13D are connected to the nonvolatile memory 14.

In the nonvolatile memory 14, apart from the transfer sheet width data D1, the image detection data Dp1 and Dp2, the color misregistration correction data De, are stored the elapsed time information D[T1], D[T2], D[T3], and D[T4], and the like.

The nonvolatile memory 14 is connected to the correction amount calculating section 51 and the CPU 57. The correction amount calculating section 51 is configured to have a main scanning correction amount calculation section 511, a sub scanning correction amount calculation section 512, a total lateral magnification correction amount calculation section 513, a partial lateral magnification correction amount calculation section 514, and a skew correction amount calculation section 515. In the correction amount calculating section 51, during the color misregistration complex correction mode or the color misregistration single correction mode, the image detection data Dp1 and Dp2 are read out from the nonvolatile memory 14, the displacement amounts for each of the different error causes (main scanning, total lateral magnification, partial lateral magnification, skew) are calculated based on these image detection data Dp1 and Dp2, and the correction amounts are obtained for each of the different error causes from these calculated displacement amounts.

For example, in the main scanning correction amount calculation section 511, the position displacement amount in the main scanning direction is calculated by reading the image detection data Dp1 and Dp2 from the nonvolatile memory 14, and timing control data D11 is output for adjusting the timing of starting to write in the main scanning direction in order to eliminate this position displacement amount. Using this timing control data D11, the position displacement in the main scanning direction is corrected.

In the sub scanning correction amount calculation section 512, the position displacement amount in the sub scanning direction is calculated by reading the image detection data Dp1 and Dp2 from the nonvolatile memory 14, and timing control data D12 is output for adjusting the timing of starting to write in the sub scanning direction in order to eliminate this position displacement amount. Using this timing control data D12, the position displacement in the sub scanning direction is corrected.

In the total lateral magnification correction amount calculation section 513, the total lateral magnification displacement amount is calculated by reading the image detection data Dp1 and Dp2 from the nonvolatile memory 14, and clock control data D13 is output for adjusting the frequency of the pixel clock signal in order to eliminate this total lateral magnification displacement amount. It is possible to correct the total lateral magnification displacement using this clock control data D13.

In the partial lateral magnification correction amount calculation section 514, the partial lateral magnification displacement amount is calculated by reading the image detection data Dp1 and Dp2 from the nonvolatile memory 14, and unit control data D14 is output for adjusting the inclination in the horizontal direction of the writing unit 3Y in order to eliminate this partial lateral magnification shift amount. It is possible to correct the partial lateral magnification shift using this unit control data D14.

In the skew correction amount calculation section 515, the skew shift amount is calculated by reading the image detection data Dp1 and Dp2 from the nonvolatile memory 14, and skew control data D15 is output for adjusting the inclination in the vertical direction of the writing unit 3Y in order to eliminate this skew shift amount. It is possible to correct the skew shift using this skew control data D15.

Figure 9:
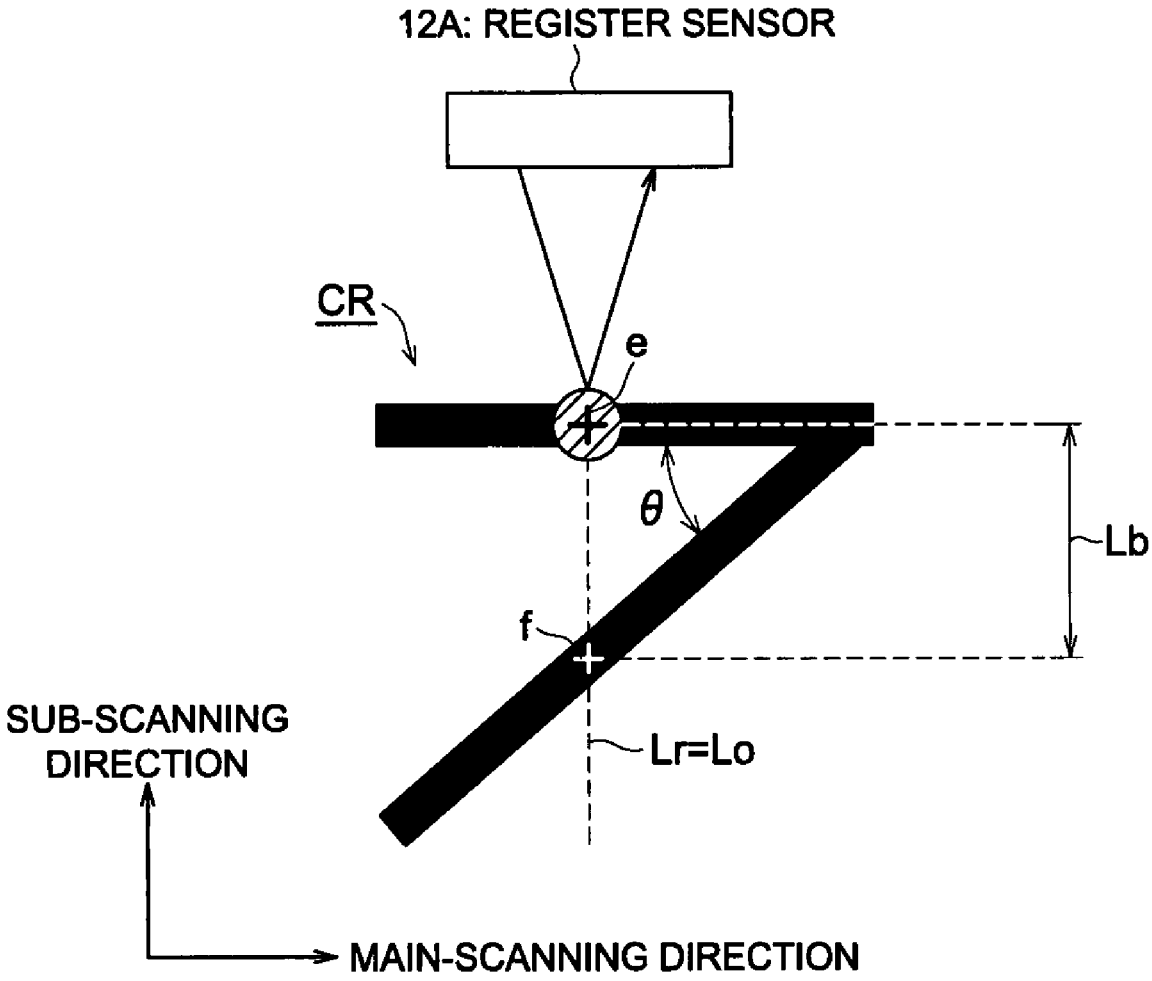
FIG. 9 is a diagram showing an example of a relationship between a register mark and a register sensor for color misregistration correction.
Figure 10:
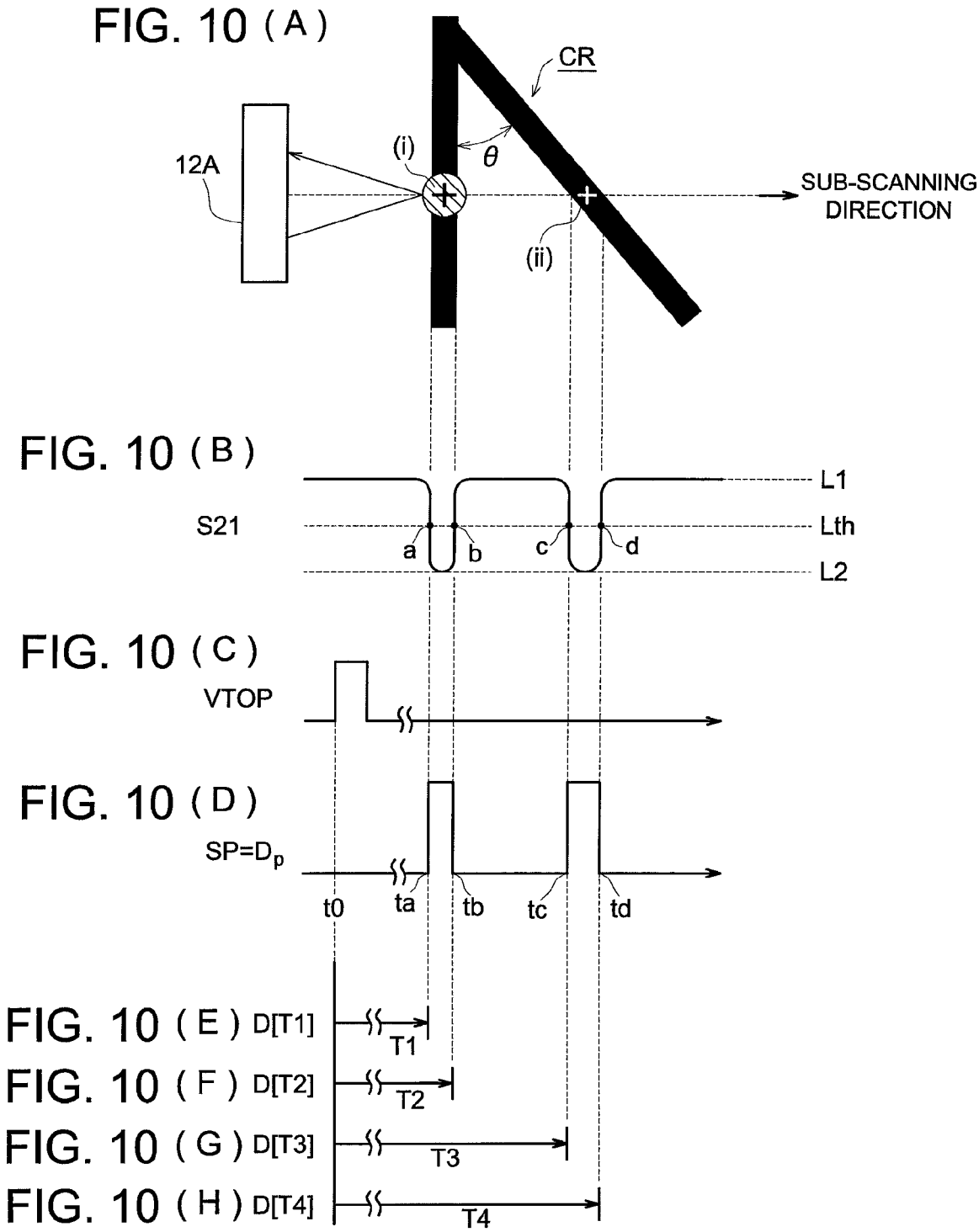
FIG. 10(A) to FIG. 10(H) are diagrams showing examples of binarizing an image detection signal in a register sensor.

FIG. 9 is a diagram showing an example of the relationship between the register mark CR and the register sensor 12A for color misregistration correction.

The register mark CR shown in FIG. 9 is applied during the color misregistration complex correction mode or during the color misregistration single correction mode, and has a line segment that is parallel to the main scanning direction and a line segment that has an angle of θ=45° to the main scanning direction. It can be described that the register mark CR is configured in the shape of a sawtooth. The register mark CR is written so that its central point e coincides with the position of incidence of the spot diameter of the register sensor 12A. The CPU 57 shown in FIG. 8 controls the image forming units 10Y, 10M, 10C, and 10K so that the register mark CR is formed on the intermediate image transfer belt 6.

In this example, from the central point e of the line part that is parallel to the main scanning direction, when an additional line is drawn that is parallel to the sub scanning direction and the point of intersection between this additional line and the line having the 45° angle is taken as the point f, the length of the line segment between these two points e and f is taken as Lb. In this example, by calculating the length Lb of the line segment between the points e and f from the difference in the detection timings of the point e and point f of the register mark CR, it is possible to detect the position displacement in the main scanning direction of the register mark CR for color misregistration correction with respect to the detection points of the register sensors 12A and 12B.

The image forming positions of the colors Y, M, and C are corrected by detecting the register marks CR for color misregistration correction using the register sensors 12A and 12B, and calculating the amount of color misregistration of the register marks CR of each color with respect to the image forming position. This correction is for correcting the image data Dy, Dm, Dc, and Dk for forming the color image in the next transfer sheet P in the image forming system after executing the color misregistration correction mode, and to superimpose the color images with a good accuracy based on this color misregistration correction.

FIG. 10(A) to FIG. 10(H) are diagrams showing examples of binarizing an image detection signal S21 in the register sensor 12A.

The register sensor 12A shown in FIG. 10(A) outputs the image detection signal S21 by detecting edges of the straight line segment (i) and the inclined line segment (ii) in the figure of the register mark CR. In this example, the angle θ of the sawtooth shape of the register mark CR is 45°. The intermediate image transfer belt 6 moves in the sub scanning direction at a constant speed. In the register sensor 12A, light is emitted towards the register mark CR from a light emitting device not shown in the figure, and the light reflected from it is detected by a light receiving device.

The image detection signal S21 shown in FIG. 10(B) is obtained from the register sensor 12A, and in this image detection signal S21, L1 is the belt (surface) detection level. Lth is the threshold value for binarizing the image detection signal S21, and L2 is the mark detection level for the register mark CR. The point a is the point at which the leading edge of the straight line part (i) of the register mark CR is detected by the register sensor 12A and that image detection signal S21 has crossed the threshold value Lth, and gives the leading edge detection instant of time ta. At this leading edge detection instant of time ta, the first passing timing pulse signal Sp shown in FIG. 10(D) rises.

The point b is the point at which the trailing edge of the straight line part (i) of the register mark CR is detected in a similar manner and that image detection signal S21 has crossed the threshold value Lth, and gives the trailing edge detection instant of time tb. At this trailing edge detection instant of time tb, the passing timing pulse signal Sp shown in FIG. 10(D) falls.

In a similar manner, the point c is the point at which the leading edge of the inclined line part (ii) of the register mark CR is detected by the register sensor 12A and that image detection signal S21 has crossed the threshold value Lth, and gives the leading edge detection instant of time tc. At this leading edge detection instant of time tc, the second passing timing pulse signal Sp shown in FIG. 10(D) rises.

The point d is the point at which the trailing edge of the inclined line part (ii) of the register mark CR is detected in a similar manner and that image detection signal S21 has crossed the threshold value Lth, and gives the trailing edge detection instant of time td. At this trailing edge detection instant of time td, the passing timing pulse signal Sp shown in FIG. 10(D) falls. The passing timing pulse Sp after this binarizing becomes the image detection data Dp. The image detection data Dp is used for calculating the amounts of shifts of the positions of writing the Y, M, and C colors with respect to the writing position of the register mark CR of the color BK.

The mark width in the sub scanning direction of the straight line part (i) of the register mark CR is obtained, when the intermediate image transfer belt 6 is moving at a constant speed in the sub scanning direction, based on the passing time T2 shown in FIG. 10(F) and the passing time T1 shown in FIG. 10(E). The passing time T1 is obtained from a counter not shown in the figure and which is started when the write start signal (VTOP signal) has risen at the instant of time t0 indicated in FIG. 10(C), and thereafter, the number of pulses of the reference clock signal are counted, and when the leading edge detection instant of time ta comes, the output of this counter becomes the passing time information D[T1].

The VTOP signal is the signal that permits writing of the register mark CR on the photoreceptor drums 1Y, 1M, 1C, and 1K (the image edge signal). In a similar manner, the passing time T2 is the output value of the counter when the counter continues to count further and outputs the passing time information D[T2] when the trailing edge detection instant of time tb comes. These passing time information D[T1] and D[T2] are stored in the nonvolatile memory 14.

At the time of calculating the color misregistration, the passing time information D[T1] and D[T2] are read out from the nonvolatile memory 14. In the control section 15, the width of the mark in the sub scanning direction of the straight line part (i) of the register mark CR is computed from (T2-T1) based on these passing time information D[T1] and D[T2].

Further, the mark width in the sub scanning direction of the inclined line part (ii) of the register mark CR is obtained, in a similar manner, from the passing time T4 shown in FIG. 10(H) and the passing time T3 shown in FIG. 10(G). The passing time T3 is obtained from a counter not shown in the figure and which is started when the VTOP signal has risen at the instant of time t0 indicated in FIG. 10(C), and thereafter, the number of pulses of the reference clock signal are counted, and when the leading edge detection instant of time tc comes, the output of this counter becomes the passing time information D[T3].

In a similar manner, the passing time T4 is the output value of the counter when the counter continues to count further and outputs the passing time information D[T4] when the trailing edge detection instant of time tb comes. These passing time information D[T3] and D[T4] are stored in the nonvolatile memory 14.

At the time of calculating the color misregistration, the passing time information D[T3] and D[T4] are read out from the nonvolatile memory 14. In the control section 15, the width of the mark in the sub scanning direction of the inclined line part (ii) of the register mark CR is computed from $\sqrt{2}\cdot(T4-T3)/2$ based on these passing time information D[T3] and D[T4]. The information obtained after these calculations becomes the color misregistration correction data. Further, since even the register sensor 12B has similar functions, its explanations will be omitted here.

Figure 11:
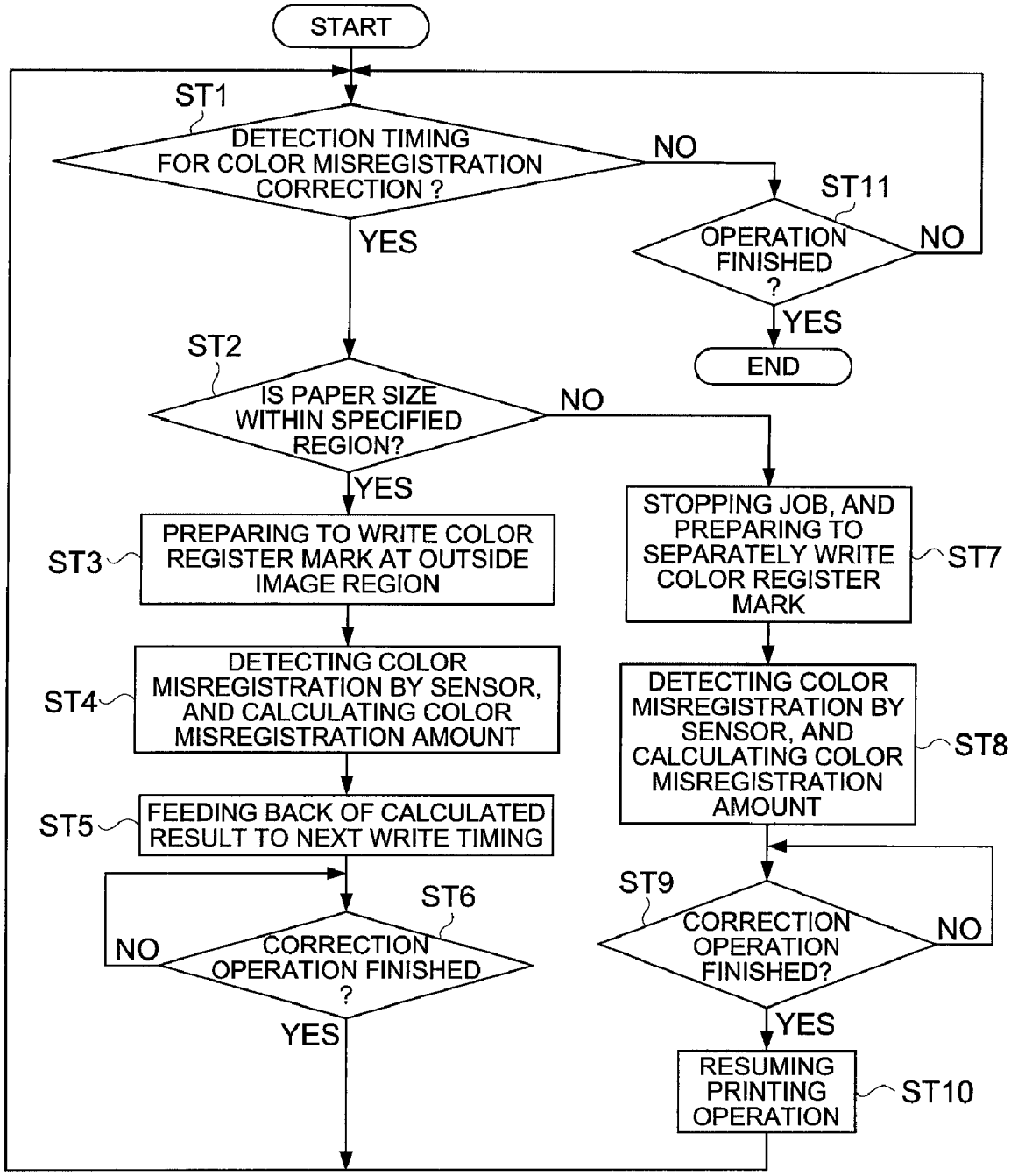
FIG. 11 is a flow chart showing an example of a correction operation of the color copying machine as a preferred embodiment.

Next, an example of operation of the color copying machine is explained here. FIG. 11 is a flow chart showing an example of the correction operation of the color copying machine 100 as a preferred embodiment. In this preferred embodiment, the color misregistration correction timing is made to change (varied) based on the transfer sheet size of the selected transfer sheet P. For example, the control section 15, selects one of the color misregistration complex correction mode or the color misregistration single correction mode based on the transfer sheet width data D1. In this example, the control section 15 executes the color misregistration correction processing for each transfer sheet.

With these as the operating conditions, in Step ST1 in the flow chart shown in FIG. 11, the control section 15 judges whether or not the color misregistration correction detection timing has come. The judgment criterion at this time is that the color misregistration correction processing is executed when the fixing temperature of the fixing unit 17 has changed and the temperature difference, for example, has become Δ2° C. higher or lower compared to the previous temperature detection value, when the image forming units 10Y, 10M, 10C, and 10K have stopped for a specific period of time, when the main power supply is turned ON, or when a forcible correction instruction is given by the user.

When it is judged that the color misregistration correction detection timing has come, the operation proceeds to Step ST2 and the control section 15 judges whether or not the size of the transfer sheet P is within the specified range. At this time, the transfer sheet width sensor 11 detects the width Wmax of the transfer sheet P fed to the image transfer system I and outputs the transfer sheet width signal S1 (transfer sheet width information) to the control section 15. In the control section 15, the width Wmax of the transfer sheet P is detected based on the transfer sheet width data D1 which is obtained by analog to digital conversion of the transfer sheet width signal S1 output from the transfer sheet width sensor 11.

After that, the control section 15 compares the image area width information Dw with the transfer sheet width data D1, and, if the width Wmax of the transfer sheet P is smaller than the width W1 of the image area, it selects the color misregistration complex correction mode, or selects the color misregistration single correction mode if the width Wmax of the transfer sheet P is larger than the width W1 of the image area.

If the transfer sheet size is within the specified range, in order to execute the color misregistration complex correction mode, the operation changes to Step ST3 in which the processing of writing the register marks CR (marks for color misregistration detection) in the non-image areas (outside the image area) of width W21 and W2*r*. In the color misregistration complex correction mode, the control section 15 executes simultaneously the processing of writing the image in the image area of width W1 and the processing of writing the register marks CR in the non-image areas.

For example, the write data Wy=image data Dy+image data Dy' is output to the write unit 3Y. In other words, the image data Dy of normal image formation that has to be written in the image area of width W1 and the image data Dy' for color misregistration correction to be written in the non-image areas of widths W21 and W2*r* on its two sides are synthesized in a serial manner in the Y-signal processing section 72Y and are output to the writing unit 3Y.

In the writing unit 3Y, control is carried out by the control section 15 so that the register marks CR for color misregistration correction are formed on the intermediate image transfer belt 6 via the photoreceptor drum 1Y. Even in the other writing units 3M, 3C, and 3K, control is carried out by the control section 15 so that the register marks CR for color misregistration correction are formed on the intermediate image transfer belt 6 via the photoreceptor drums 1M, 1C, and 1K.

After that, in Step ST4, the register sensors 12A and 12B detect the color misregistration, and the control section 15 calculates the amounts of color misregistration. For example, at the time of detecting the mark width of the register marks CR formed on the intermediate image transfer belt 6, the control section 15 detects the instant of time of detecting the leading edge and the instant of time of detecting the trailing edge of the register marks CR on the intermediate image transfer belt 6 taking as reference the write start signal (hereinafter referred to as the VTOP signal) that permits the starting of writing the register mark CR to the photoreceptor drums 1Y, 1M, 1C, or 1K, and calculates the color misregistration correction data De based on the instant of time of detecting the leading edge and the instant of time of detecting the trailing edge of the register marks CR (see FIG. 10).

Next, in Step ST5, the calculated result is fed back to the writing timing of the transfer sheet P of the next page. At this time, the CPU 57, according to the correction amounts for each error cause, adjusts the write start timing for the colors Y, M, and C, the CLK frequency, the horizontal and vertical inclinations. For example, the CPU 57 outputs the timing control data D11 prepared in the main scanning correction amount calculation section 511 to the main scanning start timing controller 52. In the main scanning start timing controller 52, the operation is made to adjust the write starting timing in the main scanning direction so as to eliminate the position displacement amount in the main scanning direction based on the timing control data D11.

Further, the CPU 57 outputs the timing control data D12 prepared in the sub scanning correction amount calculation section 512 to the sub scanning start timing controller 53. In the sub scanning start timing controller 53, the operation is made to adjust the write starting timing in the sub scanning direction so as to eliminate the position displacement amount in the sub scanning direction based on the timing control data D12.

Further, the CPU 57 outputs the clock control data D13 prepared in the total lateral magnification correction amount calculation section 513 to the pixel clock frequency controller 54. In the pixel clock frequency controller 54, the operation is made so as to correct the total lateral magnification shift amount based on the clock control data D13.

Further, the CPU 57 outputs the unit control data D14 prepared in the partial lateral magnification correction amount calculation section 514 to the writing unit drive section 55. In the writing unit drive section 55, the operation is made so as to correct the partial lateral magnification shift amount based on the unit control data D14. In addition, the CPU 57 outputs the skew control data D15 prepared in the skew correction amount calculation section 515 to the image forming unit drive section 56. In the image forming unit drive section 56, operations are made so as to correct the skew shift amount based on the skew control data D15. Because of this, it is possible to execute the main scanning correction processing, the sub scanning correction processing, the total lateral magnification correction processing, the partial lateral magnification correction processing, and the skew correction processing (see FIG. 7).

After that, the operation moves on to Step ST6 in which a judgment is made as to whether or not the color misregistration correction processing is to be ended. If the color misregistration correction processing has not been completed, the operation returns to Step ST5 and the above operations are repeated. In this example, the operation returns to Step ST1 if the color misregistration correction operation is ended.

Further, if the transfer sheet size of the transfer sheet P in Step ST2 above has exceeded the specified range, the operation moves to Step ST7 in which the image writing (JOB: printing operation) is halted, and the processing of writing individually only the register marks CR is executed without carrying out the processing of image writing in the image area. In other words, in the color misregistration single correction mode, the processing of writing the image in the image area of width W1 is stopped and only the processing of writing the register marks CR (marks for color misregistration detection) in the non-image areas (outside the image area) of width W21 and W2*r* or in the image area of width W1 is carried out.

For example, the control section 15 controls the image processing section 70 so that the write data Wy=image data Dy' is output to the writing unit 3Y. In this example, the image data Dy for normal image forming to be written in the image area of width W1 is saved in the memory, and only the image data Dy' for color misregistration correction to be written in the non-image area of widths W21 and W2*r* on the two edge sides of the image area is selected by the Y-signal processing section 72Y and is output to the writing unit 3*y*.

In the writing unit 3Y, control is carried out by the control section 15 so that the register marks CR for color misregistration correction are formed on the intermediate image transfer belt 6 via the photoreceptor drum 1Y. Even in the other writing units 3M, 3C, and 3K, in a similar manner, control is carried out by the control section 15 so that the register marks CR for color misregistration correction are formed on the intermediate image transfer belt 6 via the photoreceptor drums 1M, 1C, and 1K.

After that, in Step ST8, the color misregistration amount is detected by the register sensors 12A and 12B, and the color misregistration amounts are calculated (see Step ST4 above). Next, the operation moves on to Step ST9 and a judgment is made as to whether or not the color misregistration correction operations have ended. If the color misregistration correction processing has not been completed, the operation returns to Step ST8 and the above operations are repeated. If the color misregistration correction operation has ended, the printing operation is restarted (step ST10). After that, the operation returns to Step ST1.

In Step ST1, if the color misregistration correction timing has not been reached, the operation proceeds to Step ST11 in which a judgment is made as to whether or not to end that printing operation. If the printing operation is not to be ended, the operation returns to Step ST1. If the printing operation is to be ended, the image forming processing in that color copying machine 100 is terminated.

In this manner, according to the color copying machine 100 as a preferred embodiment, when carrying out color misregistration correction processing by detecting register marks CR for color misregistration correction, the transfer sheet width sensor 11 detects the width Wmax of the transfer sheet P fed to the image transfer system I and outputs the transfer sheet width data D1 to the control section 15. The control section 15 controls the image forming units 10Y, 10M, 10C, and 10K based on the transfer sheet width data D1 output from the transfer sheet width sensor 11. At this time, the control section 15 executes color misregistration correction processing after selecting one of the color misregistration complex correction mode or the color misregistration single correction mode based on the transfer sheet width data D1.

As a consequence, if the width Wmax of the transfer sheet P is smaller than the width W1 of the image area, it is possible to select the color misregistration complex correction mode, and if the width Wmax of the transfer sheet. P is larger than the width W1 of the image area, it is possible to select the color misregistration single correction mode. Because of this, since, in the case of the very frequently used transfer sheets P with smaller width than the width W1 of the image area, it is possible, without having to unnecessarily widen the exposable width W0 in the main scanning direction of the image forming units 10Y, 10M, 10C, and 10K, to carry out in parallel the processing of writing the image in the image area of width W1 and the processing of writing the register marks CR in the non-image area of widths W21 and W2*r*, it is possible to greatly reduce the time required for the color misregistration correction operation that is essential in a tandem type color equipment.

In addition, in the case of the less frequently used transfer sheets P' having a width larger than the width W1 of the image area, since it possible to halt (interrupt) the processing (JOB) of writing images in the image area of width W1 and to execute only the processing of writing the register marks CR in the non-image area of widths W21 and W2*r*, it is possible, on the whole, to reduce the time taken for color misregistration correction compared to the case of carrying out all in the color misregistration single correction mode. In particular, in office applications, it is possible to shorten the time taken for color misregistration correction, and it has become possible to improve the productivity of the color copying machine 100.

The present invention is ideally suitable for tandem type color printers or color copying machines having photoreceptor drums and an intermediate image transfer belt, and also capable of executing color misregistration correction processing by selecting the color misregistration complex correction mode or the color misregistration single correction mode.

What is claimed is:

1. A tandem type color image forming apparatus which executes color misregistration correction processing by detecting an imprint image for color misregistration correction, the color image forming apparatus comprising:

an image forming section;

a detecting section which detects a width of a transfer sheet fed to the image forming section and outputs transfer sheet width information; and a control section which controls the image forming section based on the transfer sheet width information output by the detecting section, wherein the image forming section has an image carrier, on which an image area in which formed is an image for transfer to the transfer sheet and a non-image area in which formed is the imprint image for color misregistration correction are arranged side by side along a main scanning direction, and a scanning exposure width in the main scanning direction is greater than a maximum width of the transfer sheet, wherein the control section selects either one of a color misregistration complex correction mode or a color misregistration single correction mode based on the transfer sheet width information, and executes the color misregistration correction processing, where, the color misregistration complex correction mode is an operation mode of executing in parallel a processing of forming the image for transfer in the image area and a processing of forming the imprint image in the non-image area, and the color misregistration single correction mode is an operation of suspending the processing of forming the image for transfer in the image area, and executing only the processing of forming the imprint image in the non-image area or in the image area.

2. The tandem type color image forming apparatus of claim 1, wherein the control section compares a width of the image area and a width of the transfer sheet, and selects the color misregistration complex correction mode when the width of the transfer sheet is not greater than the width of the image area, and selects the color misregistration single correction mode when the width of the transfer sheet is greater than the width of the image area.

3. The tandem type color image forming apparatus of claim 1, wherein the color misregistration correction processing is executed for each type including each size of the transfer sheet.

4. The tandem type color image forming apparatus of claim 1, wherein the imprint image comprises register marks of respective colors including cyan, magenta, yellow, and black.

5. The tandem type color image forming apparatus of claim 4, wherein the non-image area comprises a first and a second non-image area sandwiching the image area on the image carrier, and at least one register mark of each color is formed in each of the first and second non-image areas.

6. The tandem type color image forming apparatus of claim 4, further comprising a correction amount calculating section which calculates a displacement amount between a position of a black register mark and a position of each color register mark of cyan, magenta and yellow, the position of the black resister mark and the position of each color register mark having been detected by the detecting section, and the correction amount calculating section calculates a color misregistration correction amount for each color based on the displacement amount.

7. The tandem type color image forming apparatus of claim 1, wherein the color misregistration correction processing comprises at least one of a main scanning correction processing, a sub scanning correction processing, an overall lateral magnification correction processing, a partial lateral magnification correction processing, and a skew correction processing.

8. The tandem type color image forming apparatus of claim 1, wherein the imprint image includes a sawtooth shaped mark, which comprises a first line segment parallel to the main scanning direction and a second line segment connected to one end of the first line segment, the second line segment having a prescribed angle to the first line segment.

9. The tandem type color image forming apparatus of claim 8, the prescribed angle is approximately 45°.

10. The tandem type color image forming apparatus of claim 1, wherein the color misregistration correction processing is executed when a main power source of the image forming section is turned on after having been turned off for a prescribed period.

11. A tandem type color image forming method for executing color misregistration correction processing by detecting an imprint image for color misregistration correction, the color image forming method comprising:

a detecting step for detecting a width of a transfer sheet fed to an image forming section of an image forming apparatus, and outputting transfer sheet width information;

a first image forming step for forming an image for transfer onto a transfer sheet in an image area on an image carrier, a second image forming step for forming the imprint image for color misregistration correction in the image area or a non-image area on the image carrier, the non-image area being arranged outside the image area in a main scanning direction; and a controlling step for selecting either one of a color misregistration complex correction mode or a color misregistration single correction mode based on the transfer sheet width information, and for executing the color misregistration correction processing, where, the color misregistration complex correction mode is an operation mode of executing in parallel a processing of forming the image for transfer in the image area and a processing of forming the imprint image in the non-image area, and the color misregistration single correction mode is an operation of suspending the processing of forming the image for transfer in the image area, and executing only the processing of forming the imprint image in the non-image area or in the image area.

12. The tandem type color image forming method of claim 11, wherein in the controlling step compared are a width of the image area and a width of the transfer sheet, and selected is the color misregistration complex correction mode when the width of the transfer sheet is not greater than the width of the image area, and selected is the color misregistration single correction mode when the width of the transfer sheet is greater than the width of the image area.

13. The tandem type color image forming method of claim 11, wherein the color misregistration correction processing is executed for each type including size of the transfer sheet.

14. The tandem type color image forming method of claim 11, wherein the imprint image comprises register marks of respective colors including cyan, magenta, yellow, and black.

15. The tandem type color image forming method of claim 14, wherein the non-image area comprises a first and a second non-image area sandwiching the image area on the image carrier, and at least one register mark of each color is formed in each of the first and second non-image areas.

16. The tandem type color image forming method of claim 14, further comprising a correction amount calculating step in which calculated is a displacement amount between a position of a black register mark and a position of each color register mark, each position of each color register mark having been detected in the detecting step, and in the correction amount calculating step calculated is a color misregistration correction amount for each color based on the displacement amount.

17. The tandem type color image forming method of claim 11, wherein the color misregistration correction processing comprises at least one of a main scanning correction processing, a sub scanning correction processing, an overall lateral magnification correction processing, a partial lateral magnification correction processing, and a skew correction processing.

18. The tandem type color image forming method of claim 11, wherein the imprint image includes a sawtooth shaped mark, which comprises a first line segment parallel to the main scanning direction and a second line segment connected to one end of the first line segment, the second line segment having a prescribed angle to the first line segment.

19. The tandem type color image forming method of claim 18, the prescribed angle is approximately 45°.

20. The tandem type color image forming method of claim 11, wherein the color misregistration correction processing is executed when a main power source of the image forming section is turned on after having been turned off for a prescribed period.

* * * * *